US006343555B1

(12) United States Patent
Arai et al.

(10) Patent No.: US 6,343,555 B1
(45) Date of Patent: Feb. 5, 2002

(54) ARTICLE CARRYING/KEEPING DEVICE

(75) Inventors: Tomoaki Arai; Sakae Ishiwaka, both of Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/644,837

(22) Filed: Aug. 24, 2000

(30) Foreign Application Priority Data

Sep. 3, 1999 (JP) ..... 11-250974

(51) Int. Cl.[7] ..... B65D 19/38
(52) U.S. Cl. ..... 108/53.5; 108/56.1
(58) Field of Search ..... 108/51.11, 53.1, 108/53.5, 54.1, 55.1, 56.3; 206/600

(56) References Cited

U.S. PATENT DOCUMENTS 2,498,414 A * 2/1950 Gondar ..... 108/53.5
3,140,673 A * 7/1964 Williams ..... 108/53.5
4,673,092 A * 6/1987 Lamson et al. ..... 108/53.5
5,694,638 A 12/1997 Maruyama et al.

FOREIGN PATENT DOCUMENTS

JP 11-348985 12/1999

* cited by examiner

*Primary Examiner*—Peter M. Cuomo
*Assistant Examiner*—Jerry Anderson
(74) *Attorney, Agent, or Firm*—Oblon, Spivak, McClelland, Maier & Neustadt, P.C.

(57) ABSTRACT

In an article carrying/keeping device having a pallet for placing an article and four props provided on the pallet in a standing manner, in order to transport any size of article while placing the article on a pallet whose size is suited for the size of the article, coupling members are provided between two props so that the intervals between the props detachably attached to the four corners of the pallet on which the article is placed can be changed freely, and the respective coupling members are coupled with the props 6 via the couplers so that the first and second couplers are fixed/coupled via the coupling members.

15 Claims, 28 Drawing Sheets

ARTICLE CARRYING/KEEPING DEVICE

FIELD OF THE INVENTION

The present invention relates to article carrying/keeping device employed for carrying various articles or keeping these.

BACKGROUND OF THE INVENTION

An article carrying/keeping device employed for carrying industrial products such as electric products, its parts, architectural materials, furniture, natural products, or other various articles or keeping these has been well known. This type of conventional article carrying/keeping device is composed, for example, of a pallet for placing an article, four props fixed on the four corners of the pallet in a vertically standing manner against an article placing face, and coupling members fixing and coupling the props placed side by side. In order to carry the article by means of the article carrying/keeping device, the article is accommodated in a space inside the four props so as to place the article on the pallet, and the article is carried along with the article carrying/keeping device. The article accommodated in the article carrying/keeping device can be kept in a storage or the like along with the article carrying/keeping device.

However, although there are various sizes from a large size to a small size for an article to be carried and kept by means of this type of article carrying/keeping device, the conventional article carrying/keeping device described above has a constant capacity for the space in which an article is accommodated. Thus, with respect to a specific size of article carrying/keeping device, although an article whose size corresponds to the device can be carried and kept by the device, an article whose size is larger than the space for accommodating an article in the article carrying/keeping device cannot be carried or kept. If an article whose size is extremely smaller than the article accommodating space is carried and kept by the article carrying/keeping device, the carrying efficiency is unfavorably reduced, wastefully using the space in a storage.

SUMMARY OF THE INVENTION

It is an object of the present invention to provide an article carrying/keeping device by which the disadvantages in the prior art described above can be removed and which has an excellent stability.

In order to achieve the above described object, the present invention proposes an article carrying/keeping device comprising a pallet on which an article is placed, four props detachably attached to the pallet in an approximately vertically standing manner against an article placing face of the pallet, first and second couplers attached to the respective props along the longitudinal directions thereof, and first and second coupling members mutually coupling two props positioned adjacent to each other, wherein the second couplers are positioned lower than the first couplers in a state where the four props are attached to the pallet, the first and second coupling members are positioned mutually crossing in a state where the four props are attached to the pallet, one end sides of the respective first coupling members in the longitudinal directions thereof are rotatably coupled with the first couplers attached to one side props among two props positioned adjacent to each other, the other end sides in the longitudinal directions thereof are rotatably coupled with the second couplers attached to the other side props among two props positioned adjacent to each other, one end sides of the respective second coupling members in the longitudinal directions thereof are rotatably coupled with the first couplers attached to the other side props, the other end sides in the longitudinal directions thereof are rotatably coupled with the second couplers attached to the one side props among two props, and at least either of the first or second couplers are movably attached to the respective props to which the couplers are attached in the longitudinal directions of the props, wherein said device comprises coupler fixing members fixed to the first and second couplers attached to the respective props for fixing/coupling the first and second couplers with each other, said coupler fixing members are slidably fitted into at least one side couplers among the first and second couplers, and the couplers and the coupler fixing members are detachably/attachably fixed by screwing screws inserted into through holes formed in the couplers into which the coupler fixing members are slidably fitted onto screw holes formed in the coupler fixing members.

At that time, it is advantageous that the first and second couplers and the coupler fixing members are detachably/attachably fixed by slidably fitting the coupler fixing members into the first and second couplers and screwing the respective screws inserted into the through holes formed in the respective first and second couplers onto the screw holes formed in the coupler fixing members.

In the article carrying/keeping device of the present invention, it is advantageous to constitute in such a manner that the respective second couplers are fixed to the respective props to which the second couplers are attached, and the screws fixing the coupler fixing members to the second couplers are constituted in such a manner that loosening the screws fixing the coupler fixing members to the second couplers is more difficult than loosening the screws fixing the coupler fixing members to the first couplers Further, in the article carrying/keeping device of the present invention, it is advantageous to constitute in such a manner that the first couplers and the coupler fixing members are detachably/attachably fixed by fixing the respective second couplers to the respective props to which the second couplers are attached, undetachably fixing the coupler fixing members to the second couplers, and screwing the screws inserted into the through holes formed in the first couplers onto the screw holes formed in the coupler fixing members slidably fitted into the first couplers.

In order to achieve the aforementioned object, the present invention proposes an article carrying/keeping device comprising a pallet on which an article is placed, first to fourth props detachably attached to the pallet in an approximately vertically standing manner against an article placing face of the pallet, first to third couplers attached to the respective first to fourth props along the longitudinal directions thereof, and first and second coupling members mutually coupling the respective first and second props, the second and third props, the third and fourth props, and the fourth and first props positioned adjacent to each other, wherein in a state where the four props are attached to the pallet, the second and third couplers are positioned lower than the first couplers, and the second couplers are positioned lower than the third couplers, and in a state where the first to fourth props are attached to the pallet, the respective first and second coupling members are positioned in a state where the respective first and second coupling members cross mutually, respective one end sides of the first and second coupling members provided between the first and second props positioned adjacent to each other and the first and second coupling members provided between the third and fourth props positioned facing to the first and second props in the respective longitudinal directions of the members are rotatably coupled with the respective first couplers attached to the first and second props and the third and fourth props, the respective other end sides in the longitudinal directions thereof are rotatably coupled with the respective second couplers attached to the first and second props and the third and fourth props, respective one end sides of the first and second coupling members provided between the second and third props positioned adjacent to each other and the first and second coupling members provided between the fourth and first props positioned facing to the second and third props in the longitudinal directions of the members are rotatably coupled with the respective first couplers attached to the second and third props and the fourth and first props, the respective other end sides in the longitudinal directions thereof are rotatably coupled with the respective third couplers attached to the second and third props and the fourth and first props, and at least either of the second or third couplers among the first to third couplers are movably attached to the respective props to which the couplers are attached in the longitudinal directions of the props, wherein said device comprises coupler fixing members fixed to the second and third couplers attached to the respective props for fixing/coupling the second and third couplers with each other, said coupler fixing members are slidably fitted into at least one side couplers among the second and third couplers, and the couplers and the coupler fixing members are detachably/attachably fixed by screwing screws inserted into through holes formed in the couplers into which the coupler fixing members are slidably fitted onto screw holes formed in the coupler fixing members.

At that time, it is advantageous to constitute in such a manner that the second and third couplers and the coupler fixing members are detachably/attachably fixed by slidably fitting the coupler fixing members into the second and third couplers and screwing the respective screws inserted into the through holes formed in the respective second and third couplers onto the screw holes formed in the coupler fixing members.

In the article carrying/keeping device of the present invention, it is advantageous to constitute in such a manner that the screws fixing the coupler fixing members to the second couplers are constituted in such a manner that loosening the screws fixing the coupler fixing members to the second couplers is more difficult than loosening the screws fixing the coupler fixing members to the third couplers.

Further, in the article carrying/keeping device of the present invention, it is advantageous to constitute in such a manner that the third couplers and the coupler fixing members are detachably/attachably fixed by undetachably fixing the coupler fixing members to the second couplers, slidably fitting the coupler fixing members into the third couplers, and screwing the screws inserted into the through holes formed in the third couplers onto the screw holes formed in the coupler fixing members.

Moreover, in order to achieve the above mentioned object, the present invention proposes an article carrying/keeping device comprising a pallet on which an article is placed, first to fourth props detachably attached to the pallet in an approximately vertically standing manner against an article placing face of the pallet, first to third couplers attached to the respective first to fourth props along the longitudinal directions thereof, and first and second coupling members mutually coupling the respective first and second props, the second and third props, the third and fourth props, and the fourth and first props positioned adjacent to each other, wherein in a state where the four props are attached to the pallet, the second and third couplers are positioned lower than the first couplers, and the second couplers are positioned lower than the third couplers, and in a state where the first to fourth props are attached to the pallet, the respective first and second coupling members are positioned in a state where the respective first and second coupling members cross mutually, respective one end sides of the first and second coupling members provided between the first and second props positioned adjacent to each other and the first and second coupling members provided between the third and fourth props positioned facing to the first and second props in the respective longitudinal directions of the members are rotatably coupled with the respective first couplers attached to the first and second props and the third and fourth props, the respective other end sides in the longitudinal directions thereof are rotatably coupled with the respective second couplers attached to the first and second props and the third and fourth props, respective one end sides of the first and second coupling members provided between the second and third props positioned adjacent to each other and the first and second coupling members provided between the fourth and first props positioned facing to the second and third props in the longitudinal directions of the members are rotatably coupled with the respective first couplers attached to the second and third props and the fourth and first props, the respective other end sides in the longitudinal directions thereof are rotatably coupled with the respective third couplers attached to the second and third props and the fourth and first props, and at least either of the second or third couplers among the first to third couplers are movably attached to the respective props to which the couplers are attached in the longitudinal directions of the props, wherein said device comprises coupler fixing members fixed to the first to third couplers attached to the respective props for fixing/coupling the first to third couplers with each other, said coupler fixing members are slidably fitted into at least two couplers among the first to third couplers, and the couplers and the coupler fixing members are detachably/attachably fixed by screwing screws inserted into through holes formed in the couplers into which the coupler fixing members are slidably fitted onto screw holes formed in the coupler fixing members.

At that time, it is advantageous to constitute in such a manner that the first to third couplers and the coupler fixing members are detachably/attachably fixed by slidably fitting the coupler fixing members into the first to third couplers and screwing the respective screws inserted into the through holes formed in the respective first to third couplers onto the screw holes formed in the coupler fixing members.

In the article carrying/keeping device of the present invention, it is advantageous to constitute in such a manner that the respective first couplers are fixed to the respective props to which the first couplers are attached, and the screws fixing the coupler fixing members to the first couplers are constituted in such a manner that loosening the screws fixing the coupler fixing members to the first couplers is more difficult than loosening the screws fixing the coupler fixing members to the second and third couplers.

Further, in the article carrying/keeping device of the present invention, it is advantageous to constitute in such a manner that the second and third couplers and the coupler fixing members are detachably/attachably fixed by fixing the respective first couplers to the respective props to which the first couplers are attached, undetachably fixing the coupler fixing members into the first couplers, and screwing the screws inserted into the through holes formed in the second and third couplers onto the screw holes formed in the coupler fixing members slidably fitted into the second and third couplers.

In the article carrying/keeping device of the present invention, it is advantageous to constitute in such a manner that the coupler fixing members are positioned approximately parallel to the props in a state where the members are attached to the couplers.

Other objects and features of this invention will become understood from the following description with reference to the accompanying drawings.

DESCRIPTION OF THE PREFERRED EMBODIMENTS

In the below, embodied examples of the present invention will be explained in detail according to drawings. First, basic structure of an article carrying/keeping device will be explained.

Figure 1:
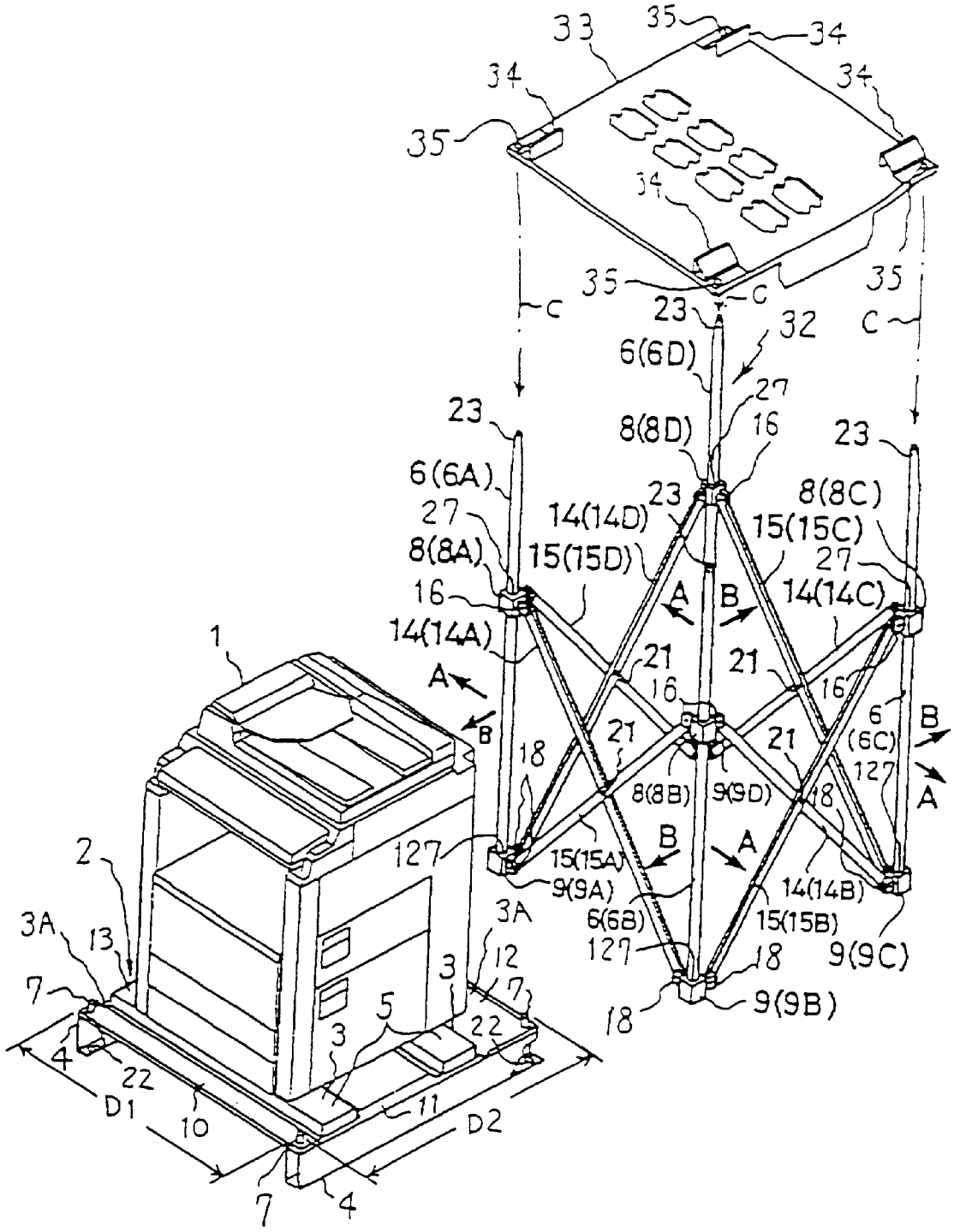
FIG. 1 is a perspective view showing one example of an article carrying/keeping device.

FIG. 1 is a perspective view showing one example of an article carrying/keeping device according to the present invention. This article carrying/keeping device comprises a pallet 2 on which an article 1, for example, being a copying machine as shown in the drawing, is placed. The pallet 2 shown as an example here has two leg portions 4 composed of hollow members extending parallel to each other, two pedestal members 3 fixed on the respective leg portions 4 in such a manner that the pedestal members build bridges over both the leg portions 4, and two reinforcement members 3A similarly fixed on both the leg portions 4. The upper faces of the pedestal members 3 constitute an article placing face 5 on which the article 1 is placed. The form of the flat face of the pallet 2 exemplified here is approximately a square. This pallet 2 is made of a metallic plate such as steel and may be made of a material with a high rigidity, such as a timber, or a hard resin. Although the pedestal members 3 and the reinforcement members 3A may be adhered with the leg portions 4 by means of welding, an adhesive, or the like, these members and portions may be fixed by means of screws or the like which are not shown in the drawing so as to easily dissolve these members and portions. Also, the pallet constituted in such a manner that an appropriate number of leg portions are fixed on the lower face of one rectangular flat plate material or other forms of pallets may be employed. Further, a pallet whose flat form is not a square but is, for example, an ellipse, a circle, or the like may be employed.

The article 1 placed on the pallet 2 is positioned and maintained on the pallet 2 by means of a positioning/maintaining means, for example, a pin, which is not shown in the drawing, or is fixed on the pallet 2 by means of a fixing means such as a bolt which is not shown.

Figure 2:
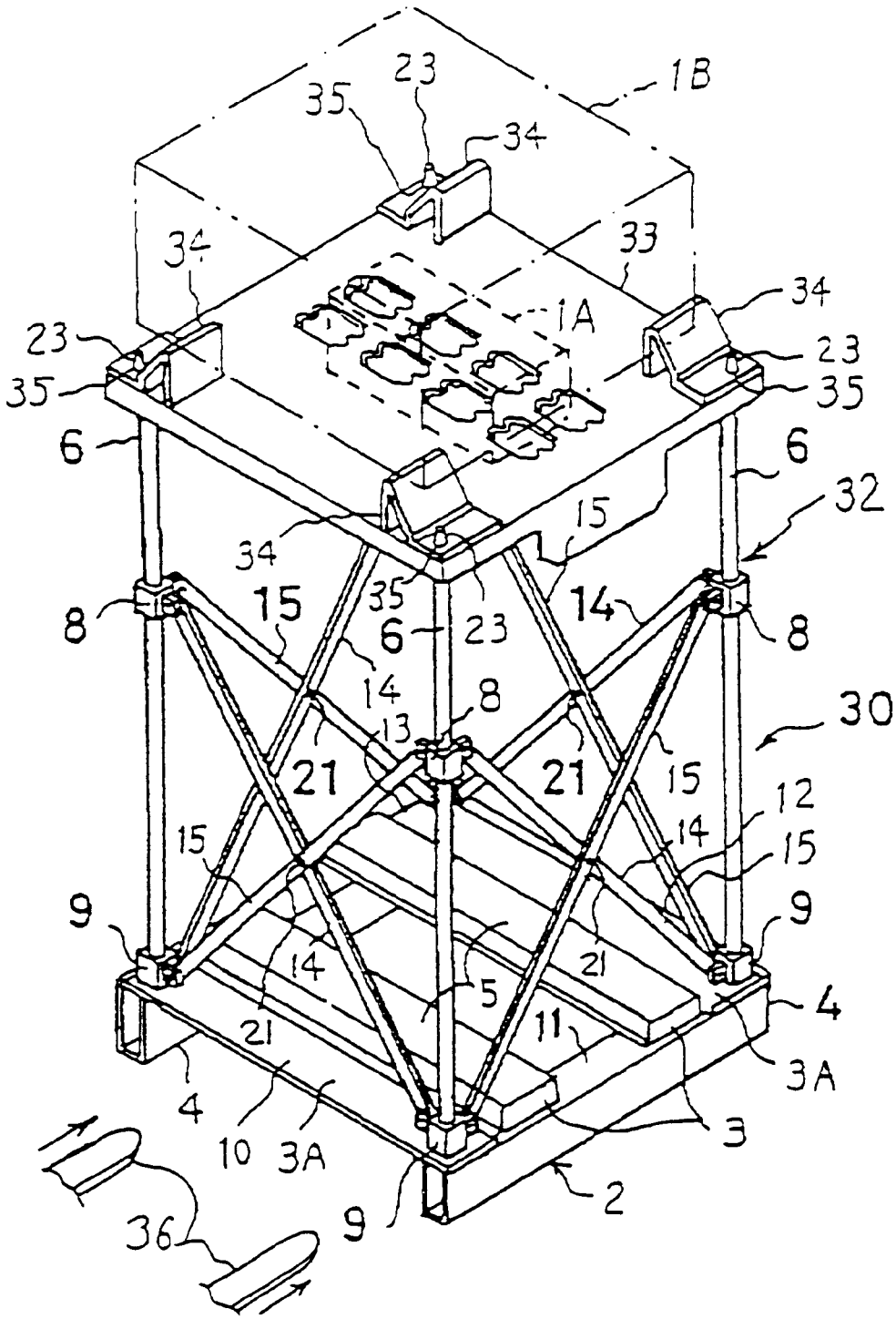
FIG. 2 is a perspective view showing a state where the article carrying/keeping device shown in FIG. 1 is assembled.
Figure 3:
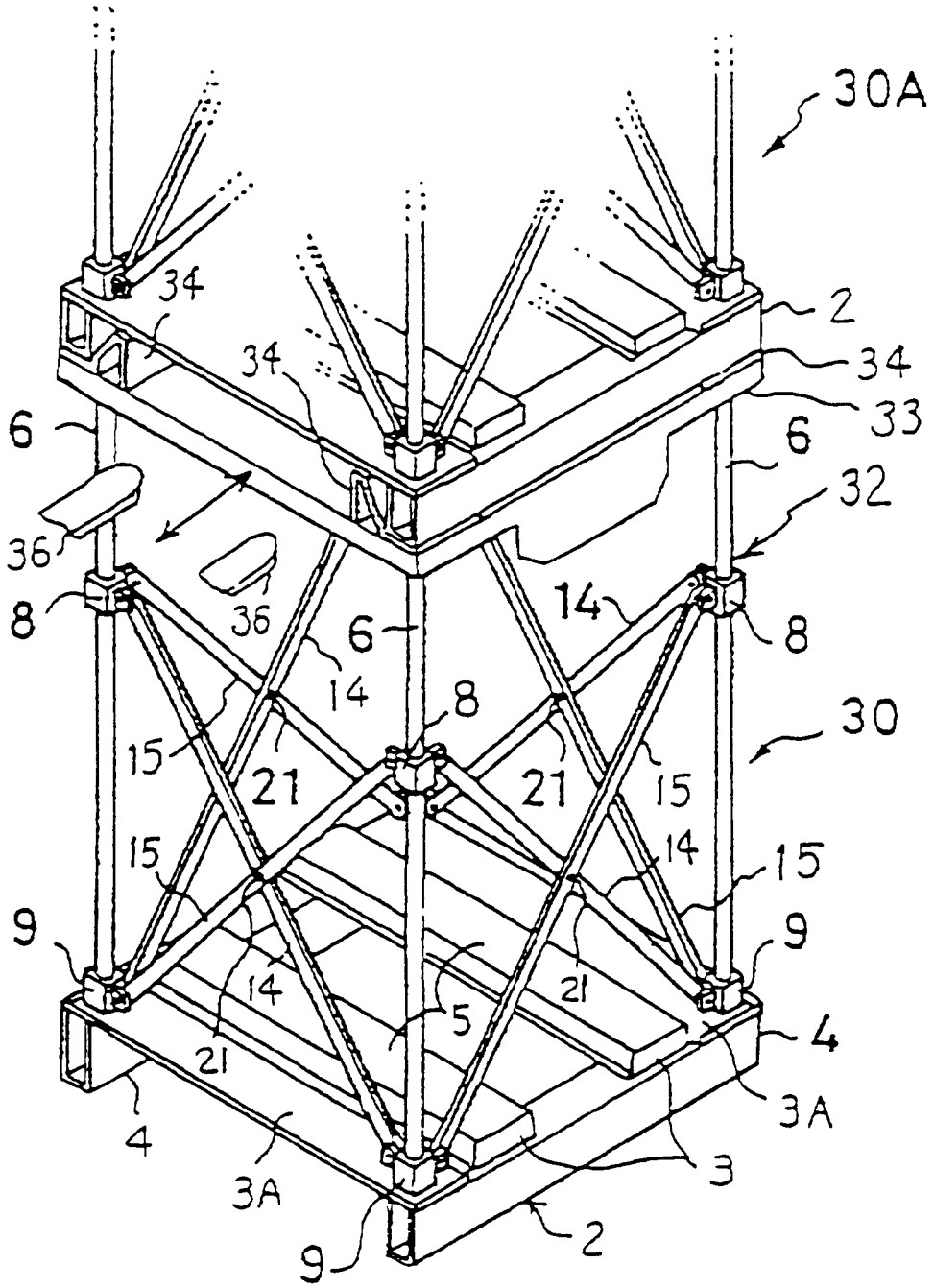
FIG. 3 is a perspective view showing the manner in which the article carrying/keeping devices shown in FIG. 1 are assembled and are vertically stacked.

The article carrying/keeping device has four props 6. These props 6 are detachably attached at the pallet 2 on the four corners of the pallet 2 in an approximately vertically standing manner on the article placing face 5 of the pallet 2 as shown in FIG. 2 and FIG. 3. Generally explaining, when a square is supposed on the pallet 2, the respective props 6 are detachably attached to respective corner portions of the square pallet part in a standing manner. The respective props 6 may be composed of a metal, a resin, a timber, or the like, and are constituted of hollow metallic pipes in the example shown in the drawing as shown also in FIG. 4 and FIG. 5. As shown in FIG. 1, the pallet 2 has protruding portions 7 composed of pins provided on the four corners of the article placing face 5 side in a protruding manner. The respective protruding portions 7 are fitted into the lower parts of the respective props 6 so that the props 6 can be detachably attached thereto. Thus, the plurality of props 6 can be detachably attached to the positions of the pallet 2 at which the article 1 placed on the pallet 2 can be enclosed by the props. The respective props 6 of the present example are attached so that the props 6 can be attached/detached easily to/from the pallet 2 by handwork and can be removed easily from the pallet 2 by handwork.

The article carrying/keeping device has first and second couplers 8, 9 attached to the respective props 6 along the longitudinal direction thereof, couples of coupling members coupling two props 6 positioned side by side each other, that is, first and second coupling members 14, 15. The respective first and second coupling members 14, 15 couple respective two props 6 attached side by side each other on each side of the pallet 2, that is, first to fourth sides 10, 11, 12, 13 lying at right angles to each other. As shown in FIG. 2 and FIG. 3, the second couplers 9 are positioned lower than the first couplers 8 in a state where the four props 6 are attached to the pallet 2, and the first and second coupling members 14, 15 are positioned so as to cross each other in a state where the four props 6 are attached to the pallet 2 similarly. The first and second coupling members 14, 15 and the first and second couplers 8, 9 constitute coupling means coupling the respective two props 6 so that the intervals between the two props 6 adjacent to each other are adjustable as explained later.

Figure 4:
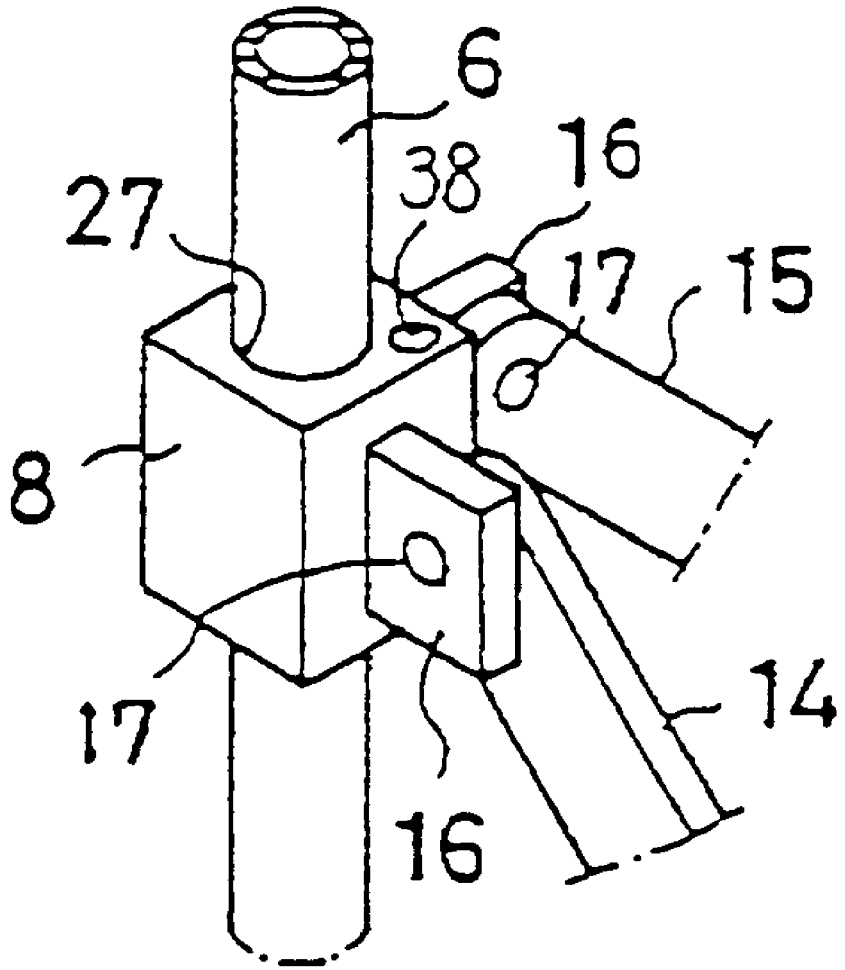
FIG. 4 is an enlarged perspective view of a first coupler shown in FIG. 1 and coupling members coupled therewith.
Figure 5:
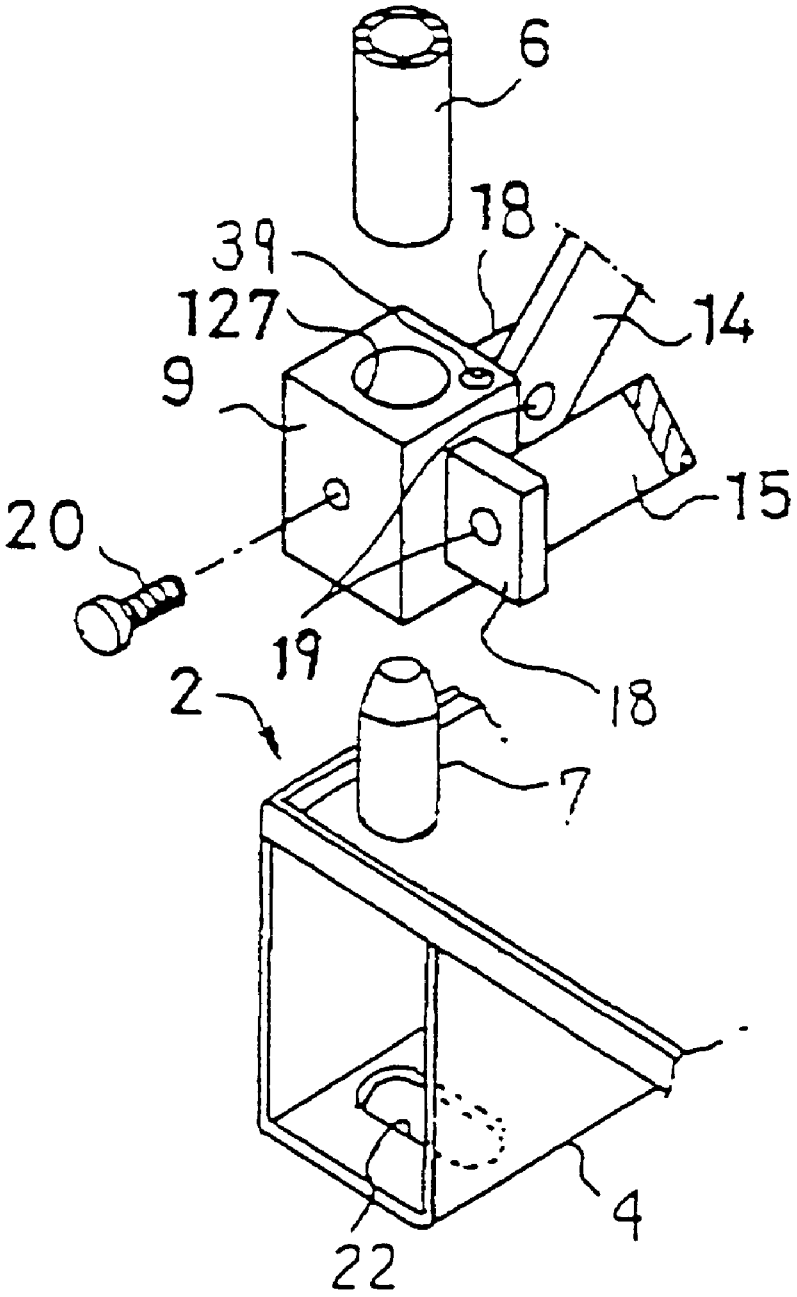
FIG. 5 is an exploded perspective view in which a prop is shown in a separated manner from a second coupler shown in FIG. 1.

The respective first and second couplers 8, 9 are constituted, for example, of tubular bodies molded by a metal, a synthetic resin, a rubber, or the like, and the respective props 6 are fitted into holes 27, 127 formed by threading in the respective couplers as shown in FIG. 4 and FIG. 5. Each of these couplers 8, 9 has two tongue pieces 16, 18 (refer also to FIG. 15 to FIG. 18), respectively, and the respective end portions in the longitudinal directions of the first and second coupling members 14, 15 are rotatably coupled with the respective tongue pieces 16, 18 via respective pins 17, 19. The first and second coupling members 14, 15 are also made, for example, of a rigid body, such as a timber, a hard resin, a metal, or the like and are formed into a rod shape or a thin plate shape.

When the four props 6 described above are needed to be distinguished, these are called a first prop 6A, a second prop 6B, a third prop 6C, and a fourth prop 6D, respectively, and similarly, reference numerals 8A, 9A; 8B, 9B; 8C, 9C; 8D, 9D are attached to the respective first and second couplers 8, 9 attached to the props 6A to 6D, respectively, so as to distinguish these as shown in FIG. 1. Similarly, reference numerals 14A, 15A; 14B, 15B; 14C, 15C; 14D, 15D are attached to the first and second coupling members coupling the first and second props 6A, 6B, the second and third props 6B, 6C, the third and fourth props 6C, 6D, and the fourth and the first props 6D, 6A each other, respectively, so as to distinguish these. This configuration will be the same also in the embodied examples described below.

The first and second coupling members 14, 15 are swingably coupled with the couplers as follows.

As shown in FIG. 1 to FIG. 3, in the first coupling member 14A provided between the first and second props 6A, 6B attached side by side on the first side 10 of the pallet 2, one end side in the longitudinal direction is rotatably coupled with the first coupler 8A attached to the first prop 6A as a prop of one side via the pin 17 (FIG. 4) as described earlier, and the other end side in the longitudinal direction is rotatably coupled with the second coupler 9B attached to the second prop 6B as a prop of the other side via the pin (refer to FIG. 5). In the second coupling member 15A provided between the first and second props 6A, 6B, one end side in the longitudinal direction is rotatably coupled with the first coupler 8B attached to the second prop 6B as a prop of the other side via the pin (refer to FIG. 4), and the other end side in the longitudinal direction is rotatably coupled with the second coupler 9A attached to the first prop 6A as a prop of one side via the pin 19 (refer to FIG. 5). These relationships are the same as those in the first and second coupling members 14B, 15B provided between the second prop 6B and the third prop 6C attached side by side on the second side 11 of adjacent to the first side 10 of the pallet 2, the first and second coupling members 14C, 15C provided between the third prop 6C and the fourth prop 6D attached side by side on the third side 12 of adjacent to the second side 11, and the first and second coupling members 14D, 15D provided between the fourth prop 6D and the first prop 6A attached side by side on the fourth side 13 of adjacent to the third side 12.

In the article carrying/keeping device shown in FIG. 1 to FIG. 5, in the respective first coupling members 14, one end sides in the longitudinal directions thereof are rotatably coupled with the first couplers 8 attached to one side props 6 among two props 6 positioned side by side on each side 10, 11, 12, 13 of the pallet 2, and the other end sides in the longitudinal directions thereof are rotatably coupled with the second couplers 9 attached to the other side props 6 among two props 6 positioned side by side. Also, in the article carrying/keeping device shown in FIG. 1 to FIG. 5, in the respective second coupling members 15, one end sides in the longitudinal directions thereof are rotatably coupled with the first couplers 8 attached to the other side props 6 described above, and the other end sides in the longitudinal directions thereof are rotatably coupled with the second couplers 9 attached to one side props 6 described above. The respective props 6 accomplish the function thereof as props supporting the first and second coupling members 14, 15.

At least ones of the respective first and second couplers 8, 9 coupled with the respective first and second coupling members 14, 15 as described above are movably attached to the respective props 6 to which these couplers are attached so as to be freely movable in the longitudinal directions thereof. In the example shown by drawings, each second coupler 9 is positioned on the lower part of each prop 6 and is fixed on each prop 6 by means of a screw 20, welding, or the like as shown in FIG. 5, and each prop 6 is slidably fitted into each first coupler 8 in the longitudinal direction thereof. It is also possible that the first coupler 8 is fixed to the prop 6, and the prop 6 is slidably fitted into the second coupler 9, or the props 6 are slidably fitted into both of the first and second couplers 8, 9.

With respect to the pallet 2 shown in FIG. 1, various sizes of devices corresponding to the size of the article 1 to be carried are prepared in advance. When carrying the article 1, a pallet 2 suited for the size of the article 1 is chosen, and the article 1 is placed on the upper face of the pallet 2, that is, the article placing face 5. At this time, although intervals D1, D2 between the protruding portions 7 thereof differ in accordance with the size of the pallet 2 chosen, the intervals between the props 6 can be adjusted freely so as to correspond to the spaces D1, D2 before the props 6 are attached to the pallet 2 as follows.

That is, when the two props 6A, 6B adjacent to each other among the props 6 and two props 6C, 6D facing to the props 6A, 6B are pressed in the directions in which they are separated from each other before the props 6 are attached to the pallet 2 as shown by arrows A in FIG. 1, the respective first couplers 8 slide downward against the respective props 6 so that the interval between the first and second props 6A, 6B and the interval between the third and fourth props 6C, 6D are enlarged. At this time, at the same time, the first and fourth props 6A, 6D and the second and third props 6B, 6C move in the directions in which the props are separated from each other shown by arrows B and the intervals between these props are also expanded.

Conversely, when the respective props 6 are pressed to the opposite sides to the arrows A, B, since the respective first couplers 8 move upward along the props 6, the intervals between the props adjacent to each other are reduced. In the example shown in FIG. 1, each interval between two props attached adjacent to each other on each side 10, 11, 12, 13 of the pallet 2 is adjusted being linked to each other so that the each of the intervals is changed at the same rates. That is, the above described coupling means coupling two props with each other are constituted so as to adjust the intervals linking with each other so that the intervals between two props positioned adjacent to each other change at the same rates.

After the intervals between the respective props 6 adjacent to each other are adjusted corresponding to the intervals D1, D2 between the protruding portions 7 of the pallet 2 chosen as described above, the respective protruding portions 7 of the pallet 2 on which the article 1 is placed are fitted into the lower parts of the respective props 6. At that time, the four props 6 may be constituted in such a manner that the four props 6 are detachably attached to the four corners of the pallet 2 by fitting the respective protruding portions 7 into the central holes of the respective second couplers 9 fixed on the lower part of the respective props 6. Further, the respective props 6 may be detachably attached on the pallet 2 by forming attachment holes in the four corners of the pallet and fitting the lower part of each prop into respective attachment holes.

By preparing the plurality of pallets 2 in which the intervals D1, D2 between the protruding portions 7 are different as described above, the props 6 in which the intervals have been adjusted can be attached on any one of the pallets 2.

The first and second coupling members 14, 15 may not be coupled with each other and may be in a free condition. In the example shown in the drawings, the middle part of the first and second coupling members 14, 15 forming a pair is rotatably coupled so as to freely rotate with each other by means of a pivot pin 21. Thus, the adjusting operation for the intervals between respective props can be executed without a hitch by smoothly operating the first and second coupling members 14, 15 when adjusting the intervals between respective props 6. This configuration is the same as those of embodied examples explained later.

Although the adjusting operation for the intervals between respective props described above can be executed by slidably fitting each prop 6 into the first and second couplers 8, 9 in the longitudinal direction thereof, when either of the couplers, for example, the second couplers 9 as the example shown in FIG. 1, are fixed on the props 6 and the other couplers 8 are slidably attached to the props 6, the first and second coupling members 14, 15 can be operated smoothly at the time of adjusting operation for intervals between respective props, whereby the operation can be executed easily.

The article carrying/keeping device of the present example has a top board 33 detachably attached to the upper parts of the four props 6, and this top board 33 is a part provided as the need arises as shown in FIG. 1 to FIG. 3. This top board 33 may be constituted of a material with a high rigidity, such as a metallic plate, a hard resin plate, a wooden plate, or the like, and the flat form thereof is squarely formed in the example shown in the drawings. Guide members 34 are fixed on the four corners of the upper face of the top board 33, respectively. Holes 35 passing through the four corners of the top board 33 and the respective guide members 34 fixed on the upper face of the top board 33 are formed in the board 33. Upper end portions 23 of the respective props 6 are taperingly formed.

As described above, the article 1 is placed on the article placing face 5of the pallet 2, and after the respective protruding portions 7 of the pallet 2 are fitted into the lower parts of the respective props 6 so as to attach the four props 6 to the pallet 2, the top board 33 is lowered from the upper of the four props 6 as shown by arrows C in FIG. 1 so that the upper end portions 23 of the respective props 6 are fitted into the respective holes 35 formed in the top board 33 and the guide members 34. At this time, the respective holes 35 of the top board 33 frictionally engage with the respective upper end portions 23, and the top board 33 is maintained at the position shown in FIG. 2 without moving lower than the position. Accordingly, the top board 33 is detachably attached on the upper parts of the plurality of props 6.

By fixing the props 6 on the pallet 2 and attaching the top board 33 to the upper parts of the props 6 as described above, the article carrying/keeping device 30 assembled as shown in FIG. 2 can be constituted. At this time, the article 1 (not shown in FIG. 2) placed on the article placing face 5 is accommodated in the accommodating space enclosed by the four props 6, the first and second coupling members 14, 15, and the top board 33. In this state, the article carrying/keeping device 30 can be lifted so as to carry the article 1 by, for example, inserting a fork 36 of a fork lift into the lower side of the pallet 2 and raising the fork 36. The article can be transported by moving the article carrying/keeping device 30 on which the article 1 is still placed to a truck, a vessel, or a railroad rolling stock. The article 1 accommodated in the article carrying/keeping device 30 can be kept in a storage or the like. When the article 1 is carried or kept, since the four sides and the upper part of the article 1 are enclosed by the first and second coupling members 14, 15 and the top board 33, the article 1 can be protected.

The article 1 can be taken down easily from the pallet 2 by lifting the top board 33 upward so as to taking out the top board 33 off the four props 6 and removing the four props 6 from the pallet 2. Accordingly, the article carrying/keeping device can be used many times.

Since the upper parts of the four props 6 can be coupled with each other via the top board 33 by attaching the top board 33 to the upper parts of the four props 6, even when an external force is added from a transverse direction to the props 6 at the time of carrying and keeping of the article 1, the props 6 can be prevented from being largely swung.

An article other than the article 1 may be placed on the top board 33. At that time, when dealing with a small article 1A as shown by broken lines in FIG. 2, this can be placed on the central part of the top board 33, and when dealing with a large article 1B as shown by chain lines in FIG. 2, the article 1B can be placed on the guide members 34 fixed on the top board 33. Since the respective guide members 34 are positioned in the upper of the respective props 6 as shown in FIG. 2, when the large article 1B is placed on these guide members 34, the load of the article 1B can be supported by the four props 6, whereby the article 1B can be carried or kept in a stable condition.

Engaging holes 22 are formed at four points in back side faces that are the opposite sides to the article placing face 5 of the pallet 2, that is, in the lower parts of both leg portions 4 of the pallet 2 as shown by parts partially broken away of the leg portions 4 in FIG. 1 in the present example (also refer to FIG. 5). The positions of the respective engaging holes 22 are defined so that the centers of the respective engaging holes 22 correspond to the axes of the respective props 6 when the respective props 6 are attached to the pallet 2 as shown in FIG. 2.

A plurality of article carrying/keeping devices on which the articles 1 (not shown in FIG. 3) are placed may be vertically stacked in a stable condition as shown in FIG. 3. That is, the article carrying/keeping device 30 is placed, for example, in a storage as shown in FIG. 2, and another article carrying/keeping device 30A constituted so as to be the same as the article carrying/keeping device 30 as shown in FIG. 3 is lifted up, for example, by the fork 36 of a fork lift and is placed on the article carrying/keeping device 30. At this time, the upper end portions 23 of the four props 6 of the article carrying/keeping device 30 of the lower side protrude upward from the top board 33 and the holes 35 formed in the respective guide members 34 as shown in FIG. 2, and the protruding upper end portions 23 are respectively fitted into the engaging holes 22 (FIG. 1, FIG. 5) formed in the pallet 2 of the upper side article carrying/keeping device 30A.

When the upper side article carrying/keeping device 30A is lowered and placed on the lower side article carrying/keeping device 30, the upper side article carrying/keeping device 30A is guided by the guide members 34 fixed on the top board 33 of the lower side article carrying/keeping device 30. With this, the upper side article carrying/keeping device 30A can be placed correctly with ease on the lower side article carrying/keeping device 30.

As described above, the plurality of article carrying/keeping devices 30, 30A can be stacked vertically on each other, and the article 1 can be kept, effectively utilizing the space in the storage. Further, these plurality of article carrying/keeping devices can be carried together in a state where these devices are vertically stacked.

When the fork 36 of the fork lift is inserted into or is drawn from the lower side of the pallet 2 of the upper side article carrying/keeping device 30A, since the top board 33 of the lower side article carrying/keeping device 30 is positioned under the pallet 2 of the device 30A as shown in FIG. 3, the fork 36 can be prevented from touching the article 1 (FIG. 1) placed on the pallet 2 of the lower side article carrying/keeping device 30.

Figure 6:
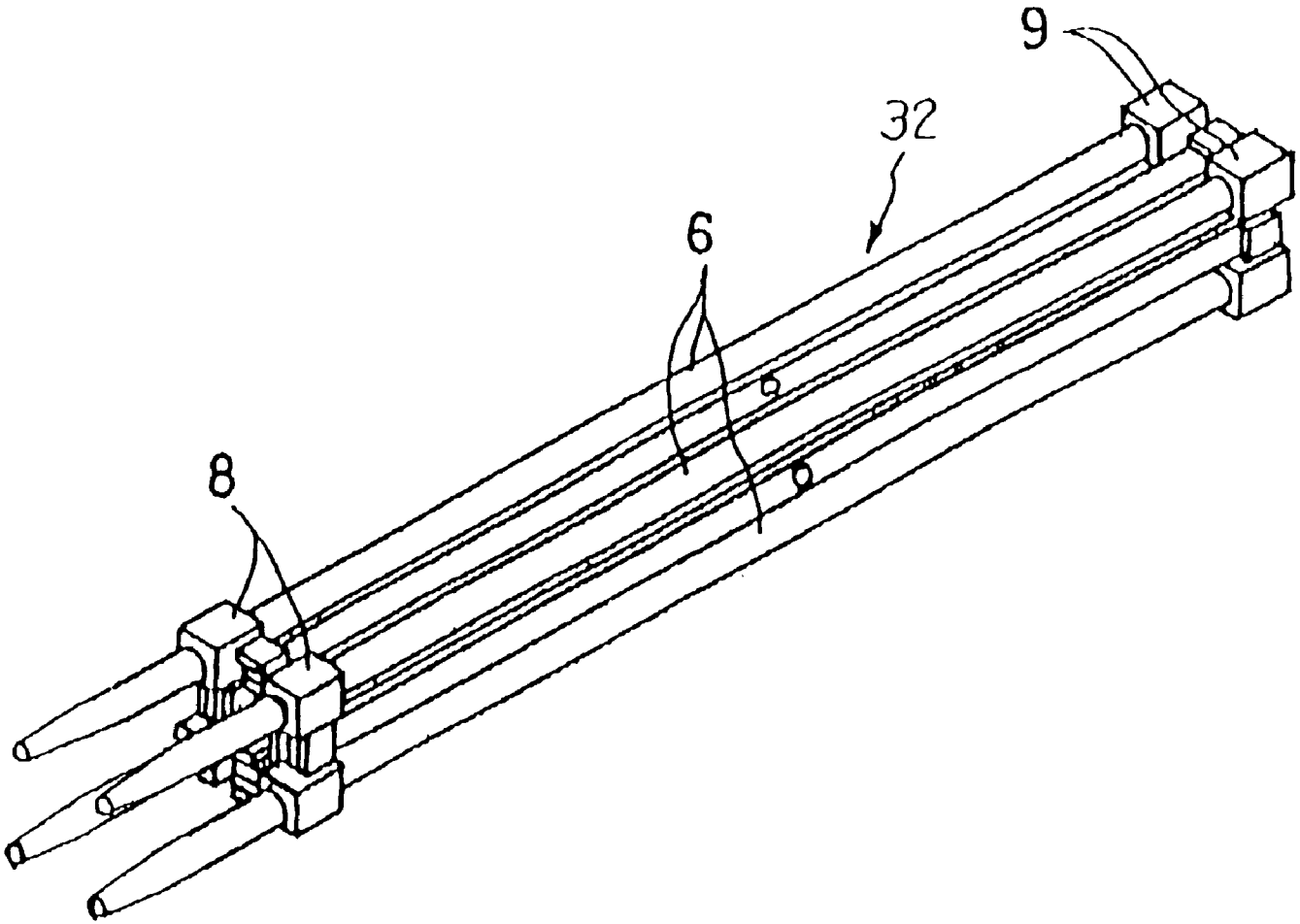
FIG. 6 is a perspective view showing a state where a prop unit own in FIG. 1 is folded up.

At an unused time of the article carrying/keeping device, the top board 33 is removed from the four props 6, and the four props 6 are removed from the pallet 2. When the respective props 6 are brought close to each other, the first and second coupling members 14, 15 are folded up so that the entire can be folded up compactly as shown in FIG. 6, whereby the entire can be put away in an extremely small space. Thus, the plurality of props 6, the plurality of members constituting the coupling means, that is, the couplers 8, 9 and the coupling members 14, 15 in this example, are constituted as a prop unit 32 foldable in a state where the plurality of props 6 are removed from the pallet 2.

As described above, according to the article carrying/keeping device shown in FIG. 1 to FIG. 6, even when the article 1 to be carried or kept has substantially any size, a pallet 2 in accordance with this size is chosen, and the article can be carried and/or kept easily by adjusting the intervals of the props 6 in accordance with the intervals D1, D2 of the protruding portions 7.

The article carrying/keeping device explained above is referred to as a first form of article carrying/keeping device as the need arises, and the carrying/keeping device explained next referring to FIG. 7 to FIG. 14 is referred to as a second form of article carrying/keeping device as the need arises. This second form of article carrying/keeping device also comprises the pallet 2 on which an article 1, for example, being a copying machine or the like, is placed, the first to fourth four props 6A, 6B, 6C, 6D detachably attached to the pallet 2 on the positions where the props can enclose the article 1 placed on the article placing face 5 of the pallet 2, and the coupling means coupling two props adjacent to each other so that the intervals between two props are adjustable. Also, the article carrying/keeping device has the top board 33 (not shown in FIG. 7) detachably attached to the upper parts of the plurality of props 6 directly or via other members.

Figure 7:
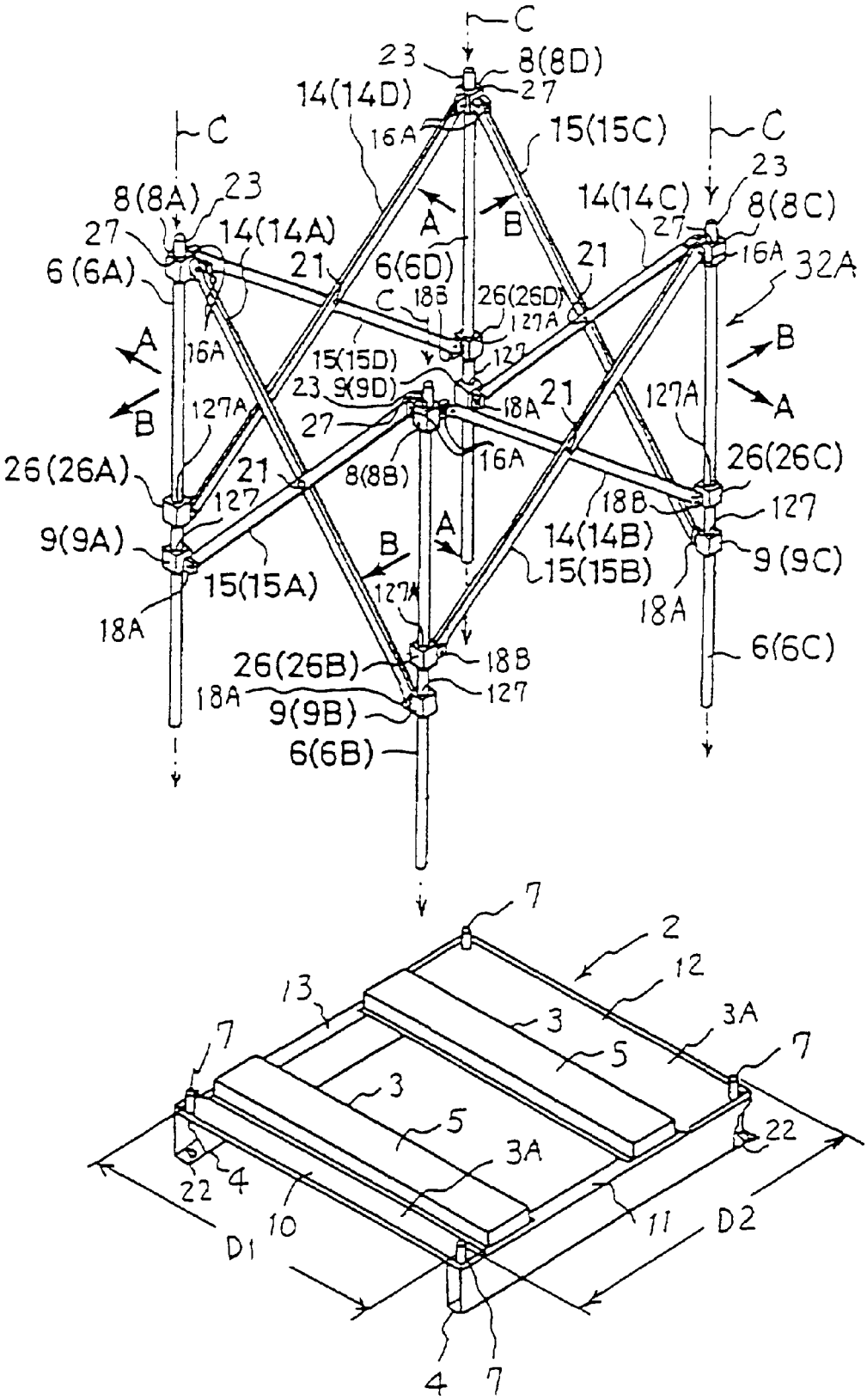
FIG. 7 is a perspective view showing an embodied example of an article carrying/keeping device that is different from that of FIG. 1.
Figure 8:
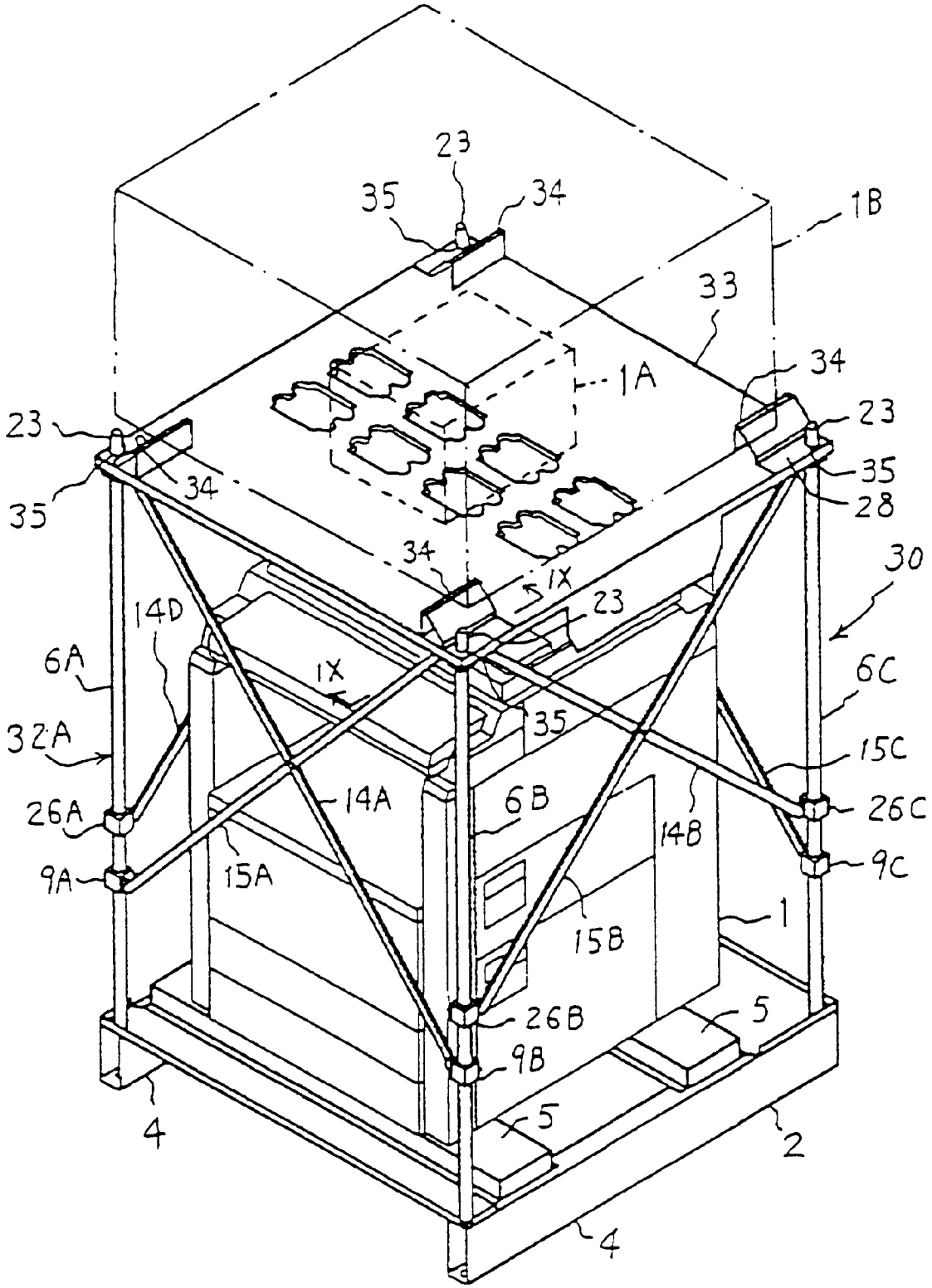
FIG. 8 is a perspective view showing the manner in which the article carrying/keeping device shown in FIG. 7 is assembled.

In this example, the first to fourth props 6A, 6B, 6C, 6D are also detachably attached on the four corners of the pallet 2 in a vertically standing manner against the article placing face 5 of the pallet 2. More generally explaining, when a square is supposed on the pallet 2, the respective props 6 are detachably attached to the respective corner portions of the square in a standing manner. Also, the example of FIG. 7 is constituted in such a manner that the respective props 6 can be easily attached to or detached from the pallet 2 by handwork by fitting the respective protruding portions 7 positioned at the four corners of the pallet 2 at the article placing face side into the lower portion of the respective props 6 composed of the hollow pipe. The structure of the pallet 2 shown in FIG. 7 and FIG. 8 is the same as that of the pallet 2 shown in FIG. 1. The top board 33 is substantially the same as the top board in the article carrying/keeping device shown in FIG. 1 to FIG. 6, wherein the guide members 34 are fixed on the four corners of the upper face of the top board, and the holes 35 passing through the top board 33 and the guide members 34 fixed on the four corners of the top board 33 are formed.

In the example shown in FIG. 7, the coupling means coupling the respective two props 6 adjacent to each other so that the intervals between the two props are adjustable comprise the first and second coupling members 14, 15 and third couplers 26 other than the first and second couplers 8, 9. Reference numerals 26A, 26B, 26C, 26D are attached to the respective these third couplers 26 so as to distinguish them.

As described above, the second form of article carrying/keeping device shown in FIG. 7 has the first to third couplers 8, 9, 26 attached to the respective first to fourth props 6A to 6D along the respective longitudinal directions of the props.

Further, similarly to the case of the first form of article carrying/keeping device shown in FIG. 1, the device has couples of coupling members coupling the first and second props 6A, 6B, the second and third props 6B, 6C, the third and fourth props 6C, 6D, and the fourth and first props 6D, 6A, respectively positioned adjacent to each other on the respective sides 10 to 13 of the pallet 2 when the props 6 are attached to the pallet 2, that is first and second coupling members 14, 15.

The respective props 6 are fitted into holes 27, 127, 127A formed in the first to third couplers 8, 9, 26. In a state where the four props 6 are attached to the pallet 2, the second and third couplers 9, 26 are positioned lower than the first couplers 8, and the second couplers 9 are positioned lower than the third couplers 26 so that the respective couples of coupling members, that is, the respective first and second coupling members 14, 15, are positioned so as to cross each other in a state where the first to fourth props 6A to 6D are attached to the pallet 2. Each first coupler 8 has two tongue pieces 16A, 16A, and each second coupler 9 and third coupler 26 has one tongue piece 18A, 18B, respectively.

The respective end portions of the respective first and second coupling members 14, 15 in the longitudinal directions thereof are swingably coupled with the tongue pieces of the respective couplers via pins similarly to the case shown in FIG. 4 and FIG. 5 as follows.

In a state where the first to fourth props 6A to 6D are attached to the pallet 2, the respective one end sides in the respective longitudinal directions of the first and second coupling members 14A, 15A provided between the respective first and second props 6A, 6B positioned adjacent to each other on the first side 10 of the pallet 2 are rotatably coupled with one tongue pieces 16A of the respective first couplers 8A, 8B attached to the first and second props 6A, 6B via pins (refer to FIG. 12), and the respective other end sides in the respective longitudinal directions thereof are rotatably coupled with the tongue pieces 18A, 18A of the second couplers 9B, 9A attached to the respective second and first props 6B, 6A via pins.

Similarly, respective one end sides in the respective longitudinal directions of the first and second coupling members 14B, 15B provided between the respective second and third props 6B, 6C positioned adjacent to each other on the second side 11 adjacent to the first side 10 of the pallet 2 are rotatably coupled with one tongue pieces 16A of the respective first couplers 8B, 8C attached to the second and third props 6B, 6C via pins (FIG. 12), and the respective other end sides in the respective longitudinal directions thereof are rotatably coupled with the tongue pieces 18B, 18B of the third couplers 26C, 26B attached to the respective third and second props 6C, 6B via pins.

Further, respective one end sides in the respective longitudinal directions of the first, and second coupling members 14C, 15C provided between the respective third and fourth props 6C, 6D positioned adjacent to each other on the third side 12 adjacent to the second side 11 of the pallet 2 are rotatably coupled with one tongue pieces 16A of the respective first couplers 8C, 8D attached to the third and fourth props 6C, 6D via pins (FIG. 12), and the respective other end sides in the respective longitudinal directions thereof are rotatably coupled with the tongue pieces 18A, 18A of the second couplers 9D, 9C attached to the respective fourth and third props 6D, 6C via pins.

Moreover, respective one end sides in the respective longitudinal directions of the first and second coupling members 14D, 15D provided between the respective fourth and first props 6D, 6A positioned adjacent to each other on the fourth side 13 adjacent to the third side 12 of the pallet 2 are rotatably coupled with one tongue pieces 16A of the respective first couplers 8D, 8A attached to the fourth and first props 6D, 6A via pins (FIG. 12), and the respective other end sides in the respective longitudinal directions thereof are rotatably coupled with the tongue pieces 18B, 18B of the third couplers 26A, 26D attached to the respective first and fourth props 6A, 6D via pins.

As described above, the first and second coupling members provided between the first and second props positioned adjacent to each other and the respective one end sides in the respective longitudinal directions of the first and second coupling members provided between the respective third and fourth props positioned opposite to the first and second props are rotatably coupled with the respective first couplers attached to the first and second props and the third and fourth props, and the respective other end sides in the respective longitudinal directions thereof are rotatably coupled with the second couplers attached to the respective first and second props and the respective third and fourth props. Further, the first and second coupling members provided between the second and third props positioned adjacent to each other and the respective one end sides in the respective longitudinal directions of the first and second coupling members provided between the respective fourth and first props positioned opposite to the second and third props are rotatably coupled with the respective first couplers attached to the second and third props and the fourth and first props, and the respective other end sides in the respective longitudinal directions thereof are rotatably coupled with the third couplers attached to the respective second and third props and the respective fourth and first props.

As described above, at least the second and third couplers 9, 26 among the first to third couplers 8, 9, 26 coupled with the respective the first and second coupling members 14, 15 are movably assembled so as to freely move in the longitudinal directions thereof against the respective props 6 attached. In the example shown in the drawings, the respective first couplers 8 positioned on the upper parts of the respective props 6 are fixed on the respective props 6, for example, by press fitting, screws, welding, or the like, and the props 6 are fitted into the second and third couplers 9, 26 so that the couplers are slidable in the longitudinal direction of the props. The respective props 6 to which the first couplers 8 are attached may be fitted also into the first couplers 8 so that the props 6 are slidable in the longitudinal direction thereof.

Figure 14:
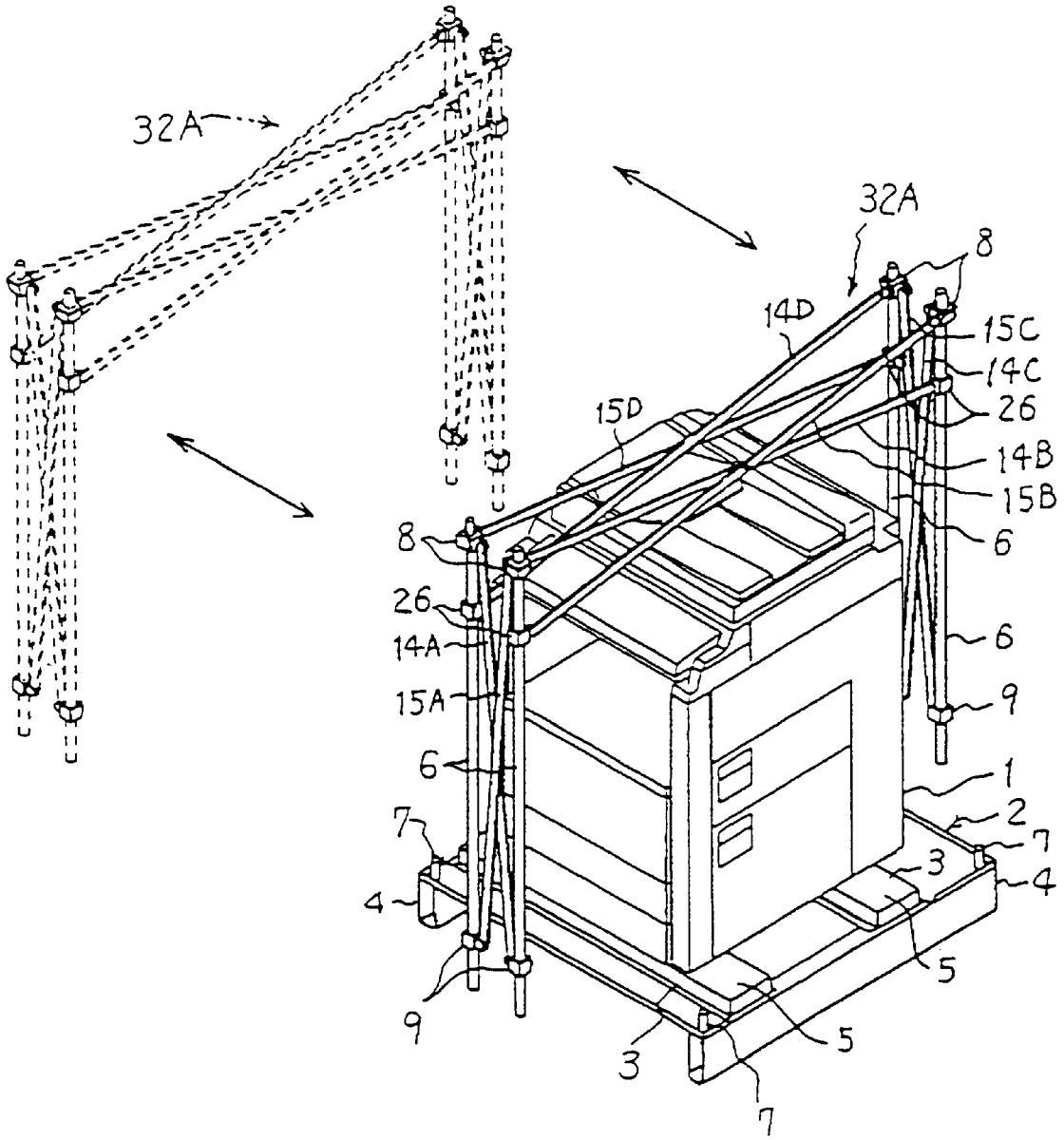
FIG. 14 is a perspective view showing a manner of the time when the prop unit is attached/detached to/from a pallet.

When the article is carried or kept by the second form of article carrying/keeping device shown in FIG. 7, a pallet 2 suited for the size of the article is chosen, and the article 1 is placed on the pallet 2 as shown in FIG. 14. The article 1 is positioned and maintained on the pallet 2 by means of a positioning/maintaining means which is not shown in the drawing, or is fixed on the pallet 2 by means of a fixing means. Before the props 6 are attached to the pallet 2, the intervals between the props 6 are adjusted so as to correspond to the intervals D1, D2 (FIG. 7) between the protruding portions 7 of the pallet 2 chosen as follows.

That is, when the first and second two props 6A, 6B and the third and fourth two props 6C, 6D adjacent to each other on the first side 10 and the third side 12 facing thereto in the pallet 2, respectively, are pressed in the directions as shown by the arrows A in FIG. 7 or the opposite directions thereto. Then, the second couplers 9 attached to these props slide upward or downward along the respective props 6. With this, the intervals between the first and second two props 6A, 6B and the intervals between the other third and fourth two props 6C, 6D change at the same rates. At that time, in this example, merely adjusting the intervals of the props 6A, 6B; 6C, 6D does not cause changes in the intervals between the second prop 6B and the third prop 6C and the intervals between the fourth prop 6D and the first prop 6A.

When these intervals are adjusted, the second and third props 6B, 6C and the fourth and first props 6D, 6A are pressed in the directions shown by the arrows B in FIG. 7 or the opposite directions thereto. With this, the third couplers 26 into which the respective props are fitted move upward/downward or downward along the respective props 6, and the interval between the second and third props 6B, 6C and the interval between the fourth and first props 6D, 6A change at the same rates.

As described above, in the second form of article carrying/keeping device, the respective intervals between two props attached adjacent to each other on respective one side of the pallet 2 and one side facing thereto are adjusted while being linked with each other so that the intervals in question change at the same rates. Further, the respective intervals between two props attached adjacent to each other on the respective other sides facing to each other of the pallet 2 are adjusted while being linked with each other so that the intervals in question change at the same rates. That is, the coupling means mentioned above coupling the respective two props are constituted so as to adjust while linking with each other the intervals between two props 6 positioned adjacent to each other and the intervals between the other two props 6 facing to the two props 6 and being positioned adjacent to each other so that the intervals in question change at the same rates. With this, the adjustment for the intervals between the respective props can be executed more freely than in the case of the first form of article carrying/keeping device shown in FIG. 1. The props 6 whose intervals are adjusted are attached to the pallet 2 on which the article 1 is placed as described above.

Figure 9:
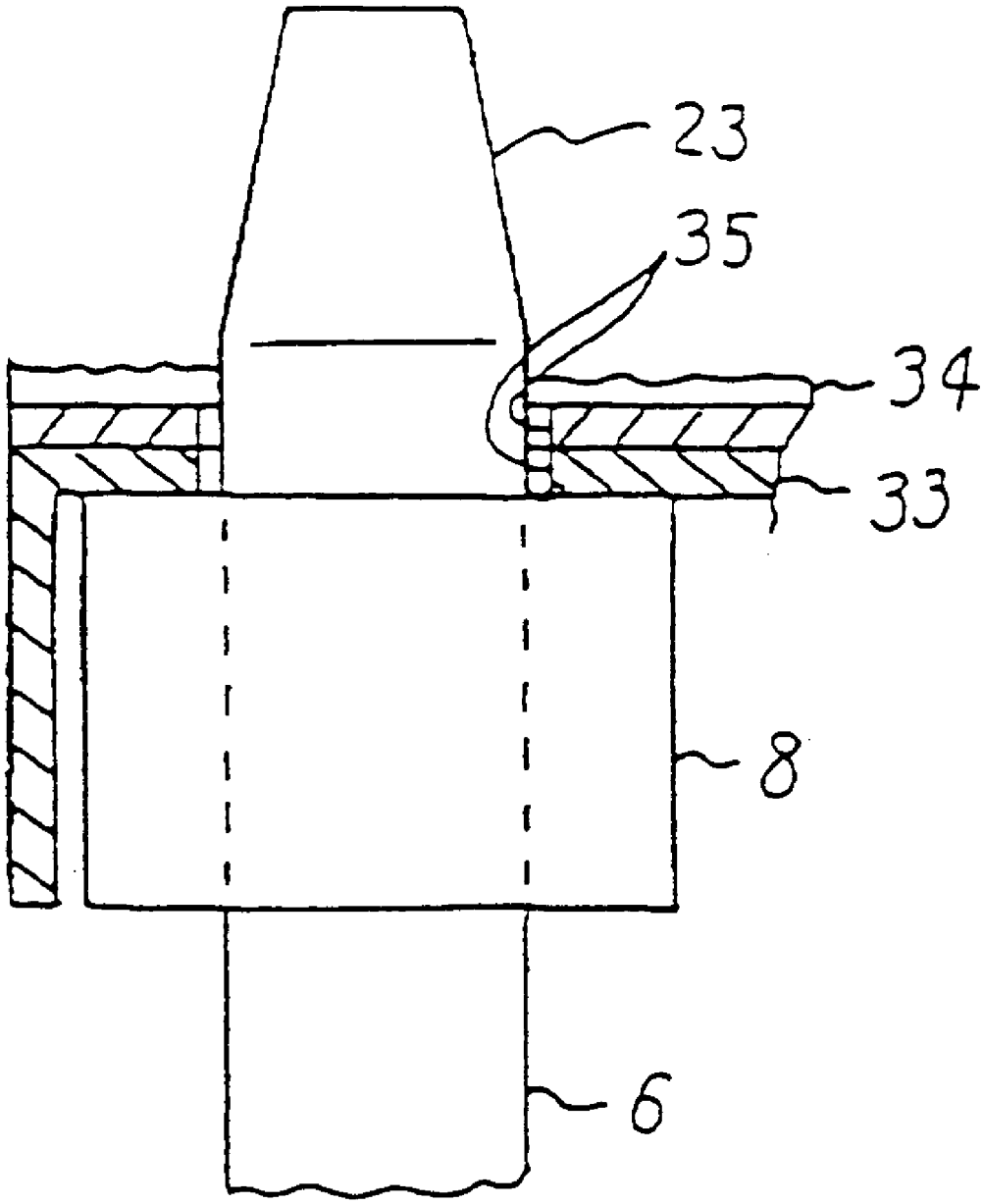
FIG. 9 is an enlarged sectional view taken on line IX—IX of FIG. 8 in which a part is omitted.

By preparing in advance pallets 2 having the intervals D1, D2 between the protruding portions 7 to which the props 6 whose intervals can be adjusted as described above can be attached, after the interval adjustment the props 6 can be attached to any pallet 2. After the four props 6 are attached to the pallet 2, the top board 33 is lowered from the upper of the props as shown by the arrows C in FIG. 7, and the upper end portions 23 of the respective props 6 are fitted into the respective holes 35 as shown in FIG. 8 and FIG. 9 so that the top board 33 is detachably attached to the upper parts of the plurality of props 6. This example is constituted in such a manner that the top board 33 is placed on the upper faces of the four first couplers 8 so as to support the top board 33 by directly fitting the upper end portions 23 of the respective props 6 protruding beyond the respective second couplers 8 into the holes 35 formed in the top board 33 and the guide members 34.

As described above, the article carrying/keeping device 30 having a similar function to the first form of article carrying/keeping device can be constituted as shown in FIG. 8, and it is unchanged from the prior example that the articles 1A, 1B shown by broken lines and chain lines in FIG. 8 can be placed on the top board 33 of the article carrying/keeping device 30.

Figure 10:
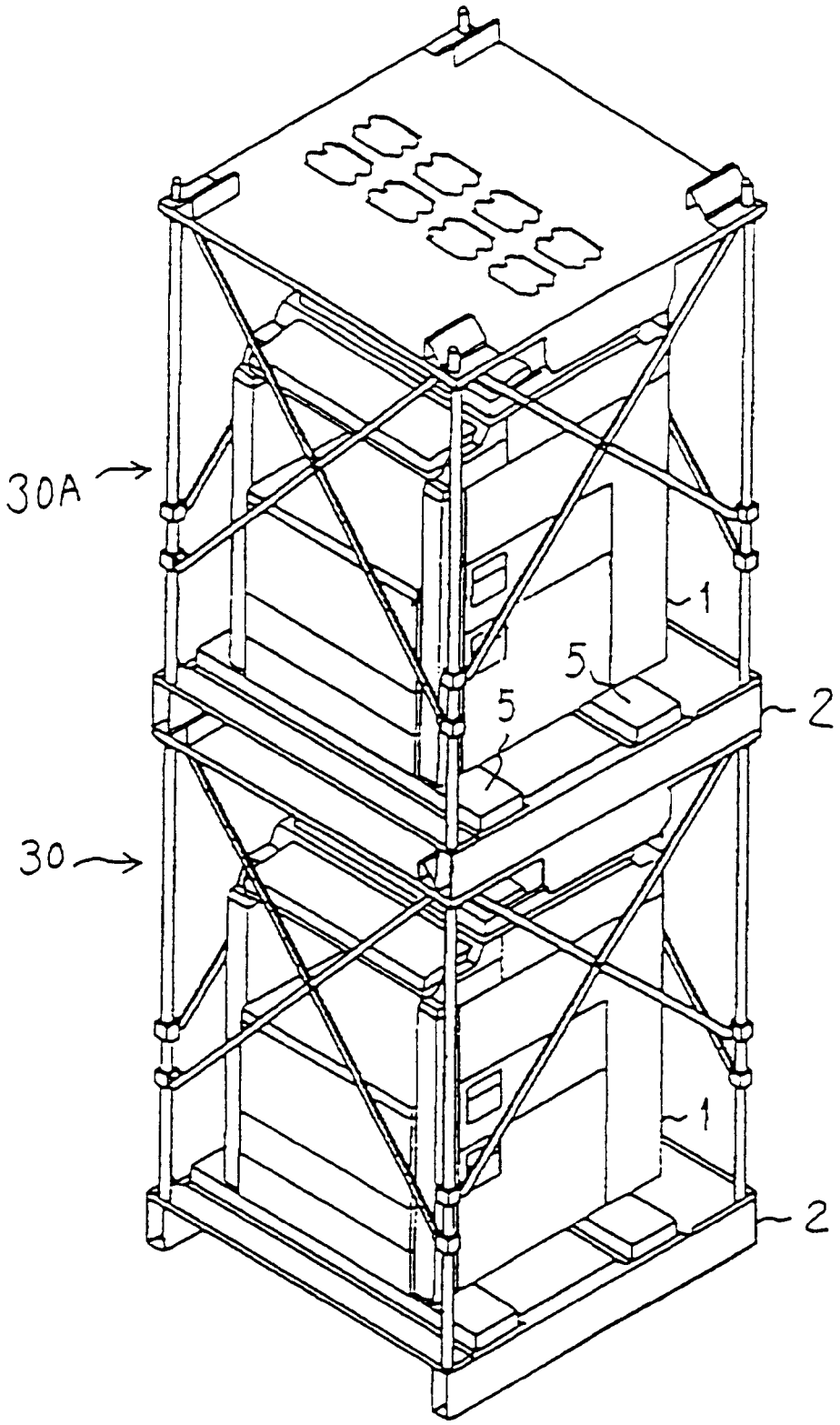
FIG. 10 is a perspective view showing the manner in which the article carrying/keeping devices shown in FIG. 7 are assembled and are vertically stacked for the plurality of steps.

In the case of the second form of article carrying/keeping device, similarly to the case of the first form of carrying/keeping device explained above, the article 1 placed on the article placing face 5 of the pallet 2 can be carried or kept. Further, the second form of article carrying/keeping devices shown in FIG. 7 can also be vertically stacked as shown in FIG. 10. Also, in this case, the upper end portions 23 of the respective props 6 protruding upward from the holes 35 of the top board 33 and the guide members 34 of the lower side article carrying/keeping device 30 are fitted into the respective four engaging holes 22 (FIG. 7) formed in back face sides that are the opposite sides to the article placing face 5 of the pallet 2 of the upper side article carrying/keeping device 30A. Thus, by vertically piling the article carrying/keeping devices 30, 30A, the articles 1 can be kept or can be transported in a small space. The article on the pallet 2 can be taken down easily to a floor face or the like by removing the top board 33 from the props 6 and taking off the four props 6 from the pallet 2. Also, in this case, when the upper side article carrying/keeping device 30A is lowered so as to place it on the lower side article carrying/keeping device 30, since the upper side article carrying/keeping device 30A is guided by the guide members 34 fixed on the top board 33 of the lower side article carrying/keeping device 30, the upper side article carrying/keeping device 30A can be placed easily on the lower side article carrying/keeping device 30.

Figure 11:
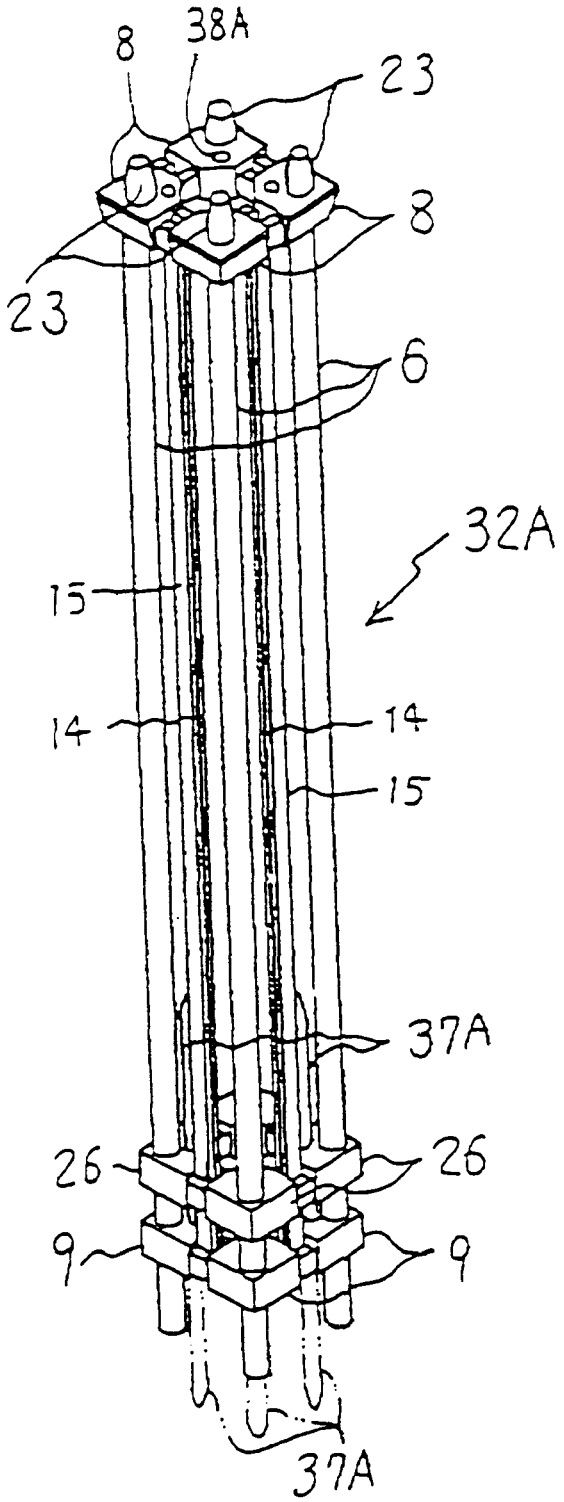
FIG. 11 is a perspective view showing a state where a prop unit shown in FIG. 7 is folded up.

Also, in the case of the second form of article carrying/keeping device shown in FIG. 7, the props 6 and the first and second coupling members 14, 15 can be folded up compactly as shown in FIG. 11 by removing the top board 33 from the respective props 6 by handwork and pulling out the props 6 from the pallet 2 by handwork. Thus, in the second form of article carrying/keeping device shown in FIG. 7, the plurality of props 6, the plurality of members constituting the coupling means, that is, the couplers 8, 9, 23 and the coupling members 14, 15 in this example, are constituted as a prop unit 32A foldable in a state where the plurality of props 6 are removed from the pallet 2.

Figure 12:
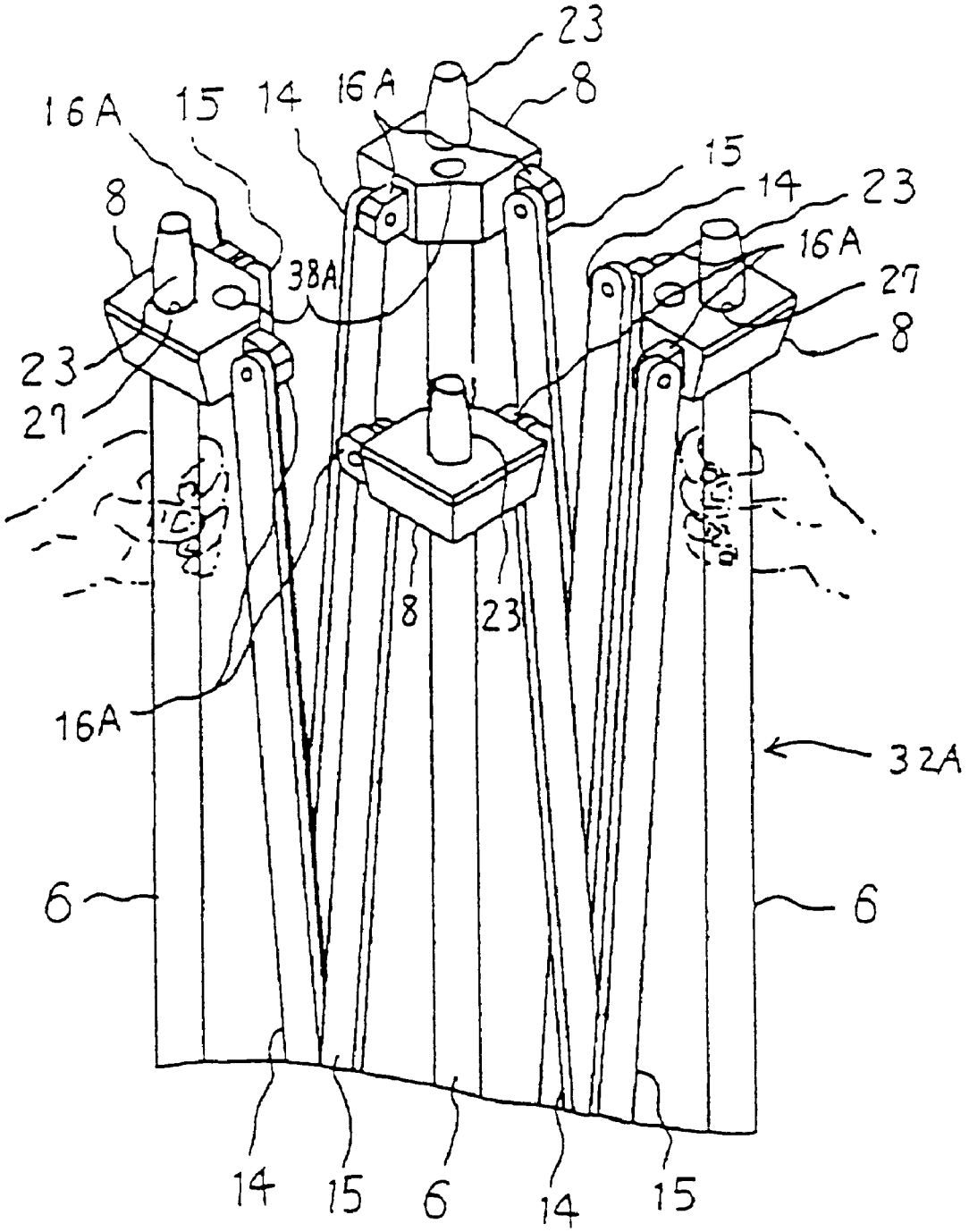
FIG. 12 is a perspective view showing the manner in which the prop unit is being folded up.
Figure 13:
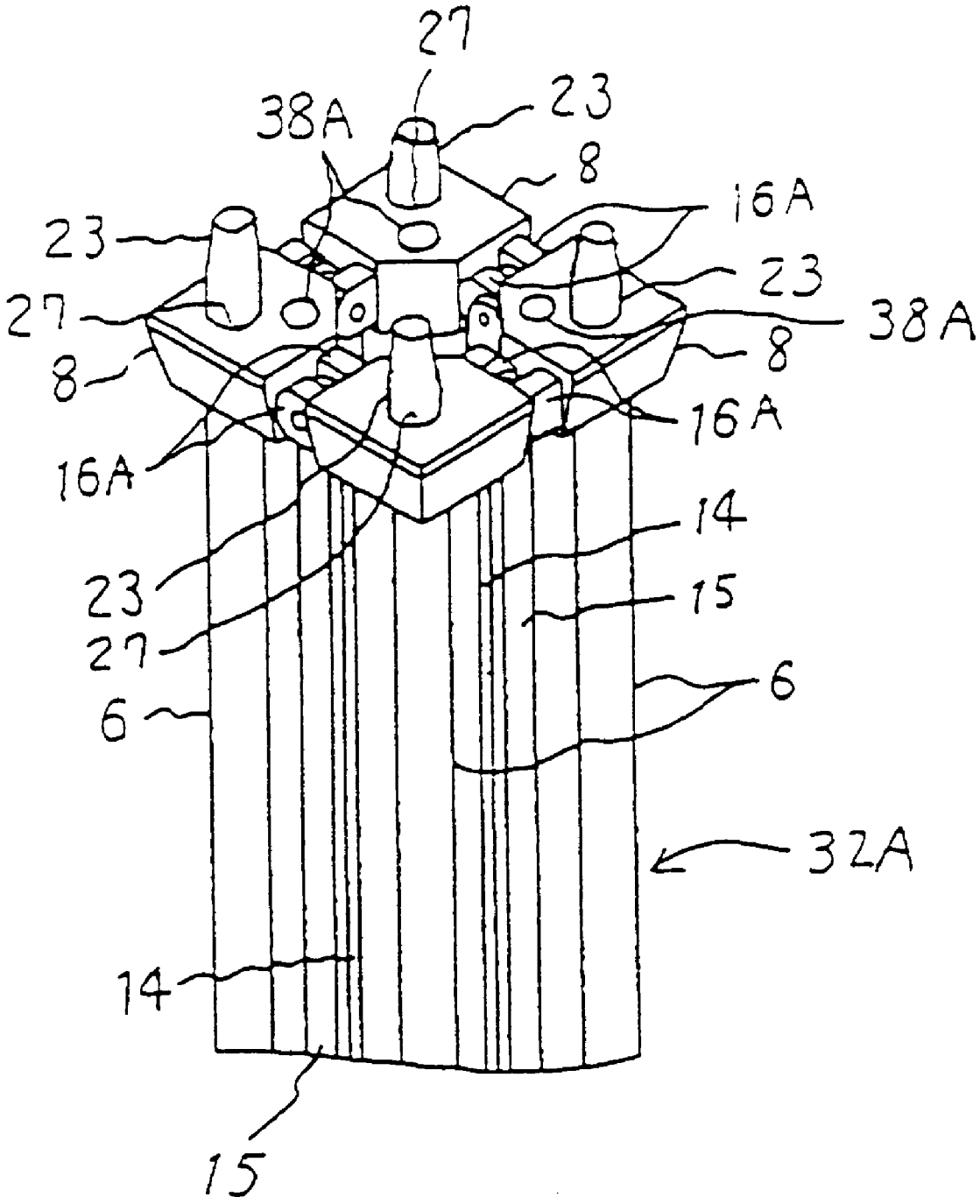
FIG. 13 is a perspective view showing part of the prop unit which has been folded up.

When the prop unit 32A is folded up, the props 6 are held by hand as shown by chain lines in FIG. 12 so as to bring the props 6 closer to each other so that the prop unit 32A can be folded up as shown in FIG. 13. This configuration is the same as that of the prop unit 32 shown in FIG. 1.

FIG. 7 shows the manner in which the article 1 which is not shown in this drawing is placed on the pallet 2, the article 1 is positioned or fixed on the pallet 2, the prop unit 32A is lowered from the upper of the pallet 2 so that the respective protruding portions 7 of the pallet 2 are fitted into the lower parts of the respective props 6, and the prop unit 32A is attached to the pallet 2 or is lifted up to be removed from the pallet 2. Through this method, in the first form of article carrying/keeping device shown in FIG. 1 to FIG. 6, too, the prop unit 32 can be detachably attached to the pallet 2.

FIG. 14 shows a using method in which the third couplers 26 of the prop unit 32A shown in FIG. 7 are slid upwardly, the first and second coupling members 14B, 15B and the first and second coupling members 14D, 15D facing thereto are lifted up, the second couplers 9 are slid downward so as to fold the respective other first and second coupling members 14A, 15A, 14C, 15C up, the prop unit 32A is moved in a horizontal direction, and the prop unit 32A is attached or removed to/from the pallet 2. With this method, since there is no need to vertically move the prop unit 32A, the work can be done very easily. Further, since the prop unit 32A is horizontally moved, largely separating the props 6 from the article 1, the attachment and the removal of the prop unit 32A to/from the pallet 2 can be executed without causing the article to be touched by the props 6 and/or the first and second coupling members 14, 15. Thus, the work can be executed without damaging the article 1.

Since both the first and second forms of article carrying/keeping devices described above can be used many times for carrying or keeping the article 1, not like the case of a conventional article carrying/keeping device which is composed of a cardboard box or the like made of paper, there is no need to dispose such cardboard box every time it is used. Thus, when employing the article carrying/keeping devices 30, 30A of the present example, the amount of waste can be reduced, or waste can be eliminated substantially.

As explaining the respective embodied examples regarding the basic structures of the article carrying/keeping device in the above, at least either of the first or second couplers 8, 9 of the first form of article carrying/keeping device, that is, the first couplers 8 in the example of the drawing, are slidably attached to the props 6 in the longitudinal direction thereof. In the case of the second form of article carrying/keeping device, at least the second and third couplers 9, 26 among the first to third couplers 8, 9, 26 are slidably attached to the props 6 in the longitudinal direction thereof, and in the example of the drawing, only the first couplers 8 are fixed to the props 6. In any form of article carrying/keeping devices, the intervals between the props adjacent to each other can be adjusted by slidably attaching predetermined couplers to the props. However, there is a case in which the article carrying/keeping device may become somewhat unstable through a small movement of the couplers against the props by an external force added to the article carrying/keeping device during transportation when the props 6 are attached to the pallet 2 so as to carry the article 1 if the couplers are slidable for the props.

Therefore, in the first form of article carrying/keeping device explained earlier referring to FIG. 1 to FIG. 6, coupler fixing members fixed on the first and second couplers 8, 9 attached to the props 6 are provided for fixing and coupling the first and second couplers 8, 9. A total of four coupler fixing members are provided for coupling the first and second couplers 8, 9 each other attached to the respective props 6, and one coupler fixing member 37 among these members is shown in FIG. 15 to FIG. 17 (the coupler fixing members are not shown in FIG. 1 to FIG. 6).

Figure 15:
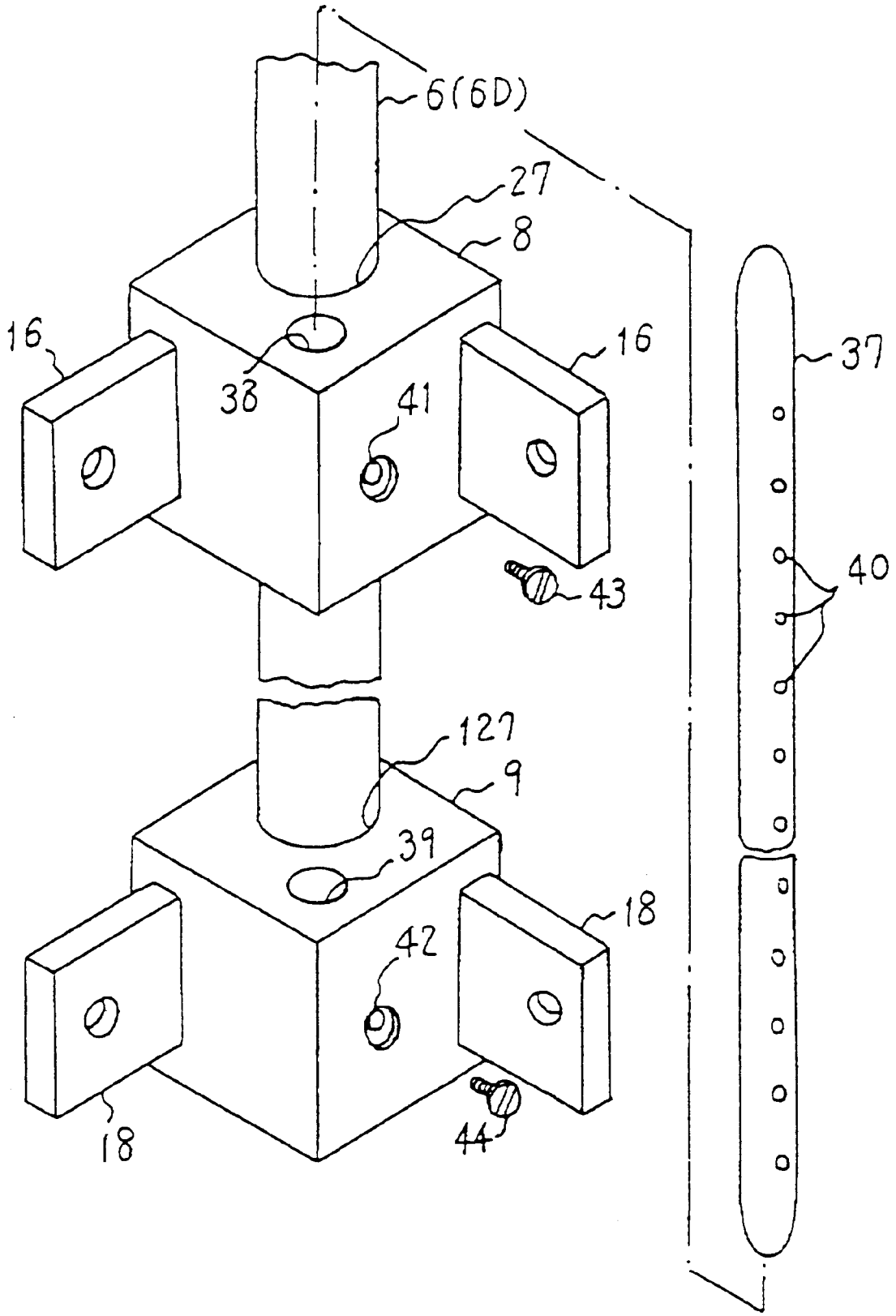
FIG. 15 is a perspective view showing a manner before a coupler fixing member is inserted into first and second couplers.
Figure 16:
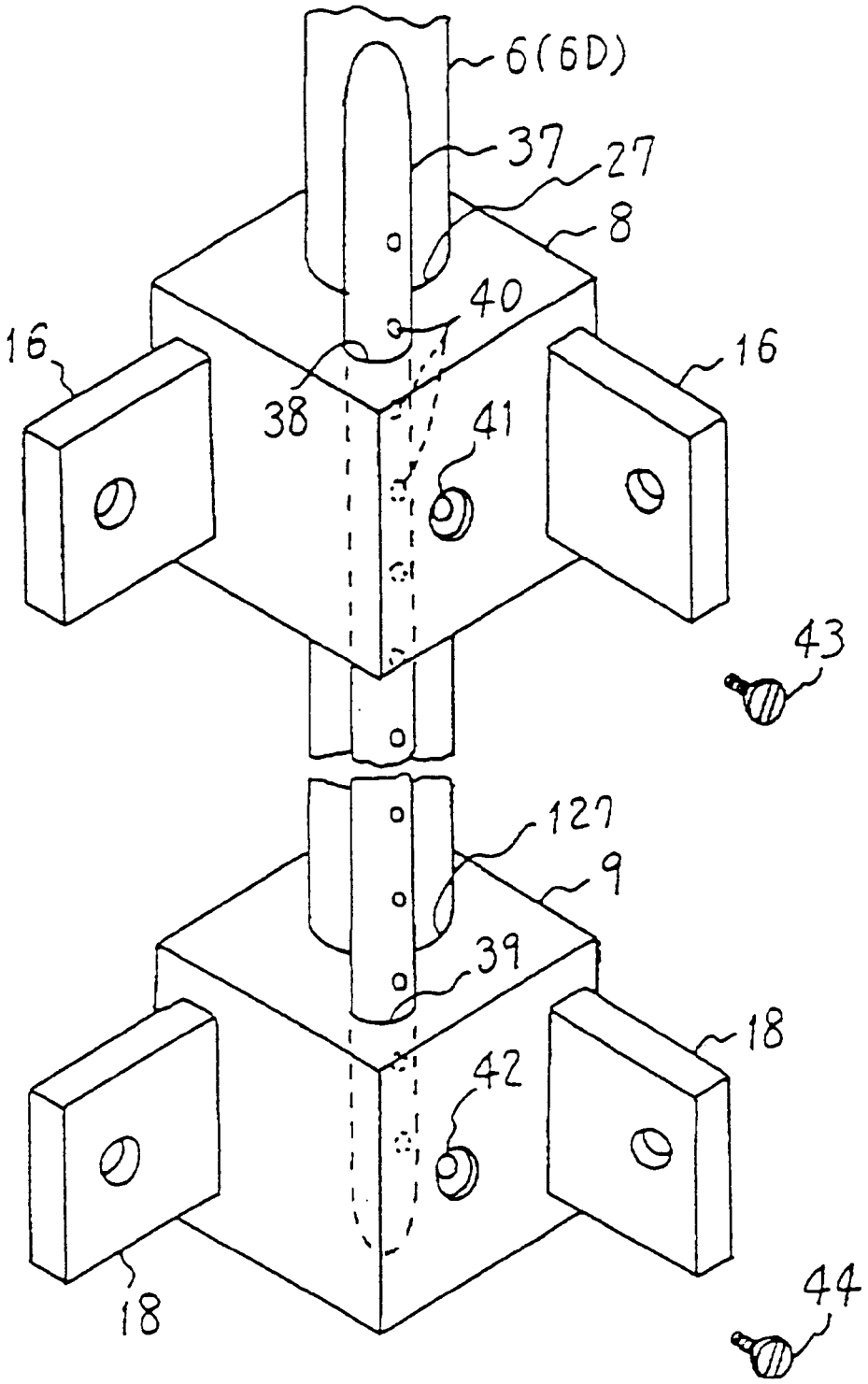
FIG. 16 is a perspective view showing a manner of the time when the coupler fixing member is inserted into the first and second couplers.
Figure 17:
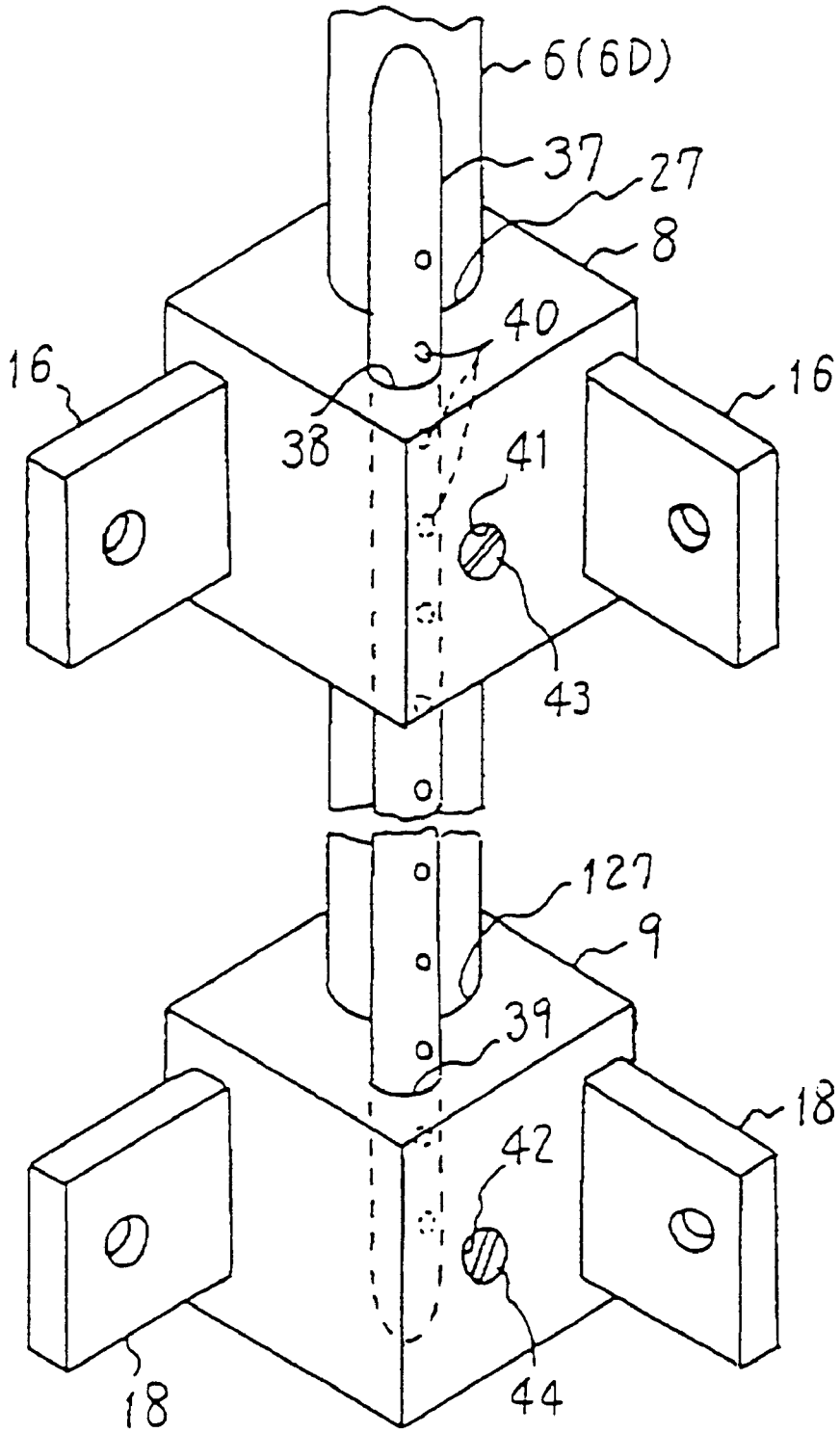
FIG. 17 is a perspective view showing a manner of the time when the coupler fixing member is fixed on the first and second couplers by means of screws.

FIG. 15 to FIG. 17 show the fourth prop 6D among the four props 6 and the second and third couplers 8, 9 attached thereto, and the coupling members on which the tongue pieces 16, 18 of the respective couplers 8, 9 are pivotally mounted are omitted in the drawings. As shown in FIG. 15, respective attachment holes 38, 39 being bored and extending parallel to the holes 27, 127 formed therein and being positioned concentrically with each other are formed in the first and second couplers 8, 9. The respective attachment holes are also formed in the first and second couplers 8, 9 attached to the other props 6A, 6B, 6C exactly in the same manner. The coupler fixing members 37 are formed into a rod shape having a diameter by which the members 37 can be inserted into the attachment holes 38, 39 without unsteadiness and having the plurality of screw holes 40 along the longitudinal direction thereof. The coupler fixing members 37 are made, for example, of a high rigidity material, such as a metal, a hard resin, or the like.

For example, in order to mutually fix the first and second couplers 8, 9 after the four props 6 are attached to the pallet 2 as described above after the intervals between the props adjacent to each other are adjusted, the coupler fixing member 37 is inserted into the attachment holes 38, 39 formed in the first and second couplers 8, 9 as shown in FIG. 16. Thus, the coupler fixing member 37 is slidably fitted into the attachment holes 38, 39 of the first and second couplers 8, 9 with respect thereto in a state where the member 37 is attached to the first and second couplers 8, 9. Next, screws 43, 44 are inserted into through holes 41, 42 formed in the respective couplers 8, 9 as shown in FIG. 17, and the respective screws 43, 44 are screwed onto any ones of female screws of the screw holes 40 formed in the coupler fixing members 37 so as to screw the respective screws 43, 44 up. With this the first and second couplers 8, 9 and the coupler fixing member 37 are detachably/attachably fixed, and the first and second couplers 8, 9 are mutually fixed/coupled via the coupler fixing members 37.

The first and second couplers 8, 9 attached to the other props are mutually fixed/coupled by the coupler fixing members in the same way as that described above.

The intervals between the props 6 attached to the respective protruding portions 7 differ in accordance with the sizes of the intervals D1, D2 (FIG. 1) of the protruding portions 7 of the pallet 2, and thus the intervals of the first and second couplers 8, 9 differ. However, when any size of pallet 2 is used, the screws 43, 44 can be screwed onto the screw holes 40 corresponding to that pallet 2, by setting the pitches of a large number of screw holes 40 formed in the coupler fixing members 37 in accordance with the intervals D1, D2 of the protruding portions 7 of various sizes of pallets 2. This configuration is similar to the case in which the couplers are fixed/coupled by means of coupler fixing members 37A, 37B described later.

As described above, by fixing/coupling the first and second couplers 8, 9 attached to the respective props 6 via the coupler fixing members 37, when the article is placed on the article carrying/keeping device and is transported, the first and second couplers 8, 9 can be prevented from moving and being out of position in relatively approaching or separating direction, whereby the article 1 can be carried in a stable condition. Further, since the second couplers 9 are fixed to the props 6 in the present example, the first couplers 8 are also fixed/coupled to/with the props 6 via the coupler fixing members 37 and the second couplers 9, thereby enhancing the entire rigidity of the article carrying/keeping device. Thus, the stability can be improved further surely.

When the intervals between the protruding portions 7 of the pallet 2 employed are known in advance, it is possible that the intervals between the props 6 are adjusted in accordance with the intervals D1, D2 of the protruding portions 7 of the pallet 2 before the props 6 are attached to the pallet 2. In this state, the first and second couplers 8, 9 are mutually fixed/coupled by the coupler fixing members 37 described above so as to fix the intervals between the respective props. With this, the props 6 can be attached quickly to the pallet 2. When the props 6 are attached to the respective plurality of pallets 2 with the same size, by adopting the method described above, the props can be attached efficiently to the pallets 2.

When the fixing between the first and second couplers 8, 9 has to be released, the screws 43, 44 are loosened, and the coupler fixing members 37 are taken out from the attachment holes 38, 39.

Other than the structure described above, the first and second couplers 8, 9 can be fixed/coupled by abutting coupler fixing members made, for example, of plates, against the outer face of the first and second couplers 8, 9, inserting screws into respective through holes formed in parts of the coupler fixing members abutting against the respective couplers 8, 9, and screwing the respective screws onto the screw holes formed in the respective couplers 8, 9 so as to fix the coupler fixing members to the first and second couplers 8, 9. However, when the respective couplers 8, 9 are constituted of a resin, if the work by which screws are screwed onto the screw holes formed in the couplers or are removed is repeatedly executed, the screw threads of the screw holes are worn away in an early stage. In order to prevent this inconvenience, for example metallic nuts may be inserted into the resinous couplers 8, 9. However, not only the cost of the couplers into which such nuts are inserted increases, but also when the couplers are used up and become needless and the resinous couplers are to be melted and recycled, the metallic nuts have to be removed from the couplers, thereby complexing the treatment work. On the other hand, in the structure shown in FIG. 15 to FIG. 17, since there is no need to form screw holes in the couplers 8, 9, even when the couplers 8, 9 are made of a resin, nuts do not have to be inserted thereto. Thus, the resinous couplers 8, 9 can be melted and recycled as they are. The coupler fixing members 37 may be made, for example, of a metal, whereby abrasion or crushing of the screw threads of the screw holes 40 in an early stage can be prevented. The point like this exists in the case of the coupler fixing members 37A, 37B described below in the same manner.

In the example shown in FIG. 15 to FIG. 17, each time the first and second couplers 8, 9 have to be mutually fixed/coupled, it is necessary to slidably fit the coupler fixing members into the attachment holes 38, 39 formed in the first and second couplers 8, 9 and then fix the coupler fixing members 37 to the first and second couplers 8, 9 by the screws 43, 44. On the other hand, the coupler fixing members 37 may be fixed in advance to either of the first or second couplers 8, 9 so that the members cannot be detached. In this way, when the coupler fixing members 37 are attached to the first and second couplers 8, 9 as shown in FIG. 16, the coupler fixing members 37 are slidably fitted into the attachment holes of the couplers which are not fixed thereto. Accordingly, by fixing only the couplers into which the coupler fixing members 37 are slidably fitted to the coupler fixing members 37 by screws, both the couplers 8, 9 can be fixed/coupled mutually, whereby the work can be simplified. Further, loss of the coupler fixing members 37 can be prevented.

Since the coupler fixing members 37 are positioned approximately parallel to the props 6 in a state where the members 37 are attached to the first and second couplers 8, 9 as shown in FIG. 16, even when the coupler fixing members 37 are detachably fixed to either of the couplers 8 or 9, before the coupler fixing members 37 are fixed to the other couplers 9 or 8 by the screws 43 or 44, the intervals between the respective props can be adjusted freely without being disturbed by the coupler fixing members 37.

On the other hand, in the example explained earlier related to FIG. 15 to FIG. 17, in a state where the coupler fixing members 37 are attached to the first and second couplers 8, 9 as shown in FIG. 16, it is necessary that the coupler fixing members 37 are slidably fitted into both of the couplers 8, 9 so as to fix the respective couplers 8, 9 to the coupler fixing members 37 by the screws 43, 44.

Any structures described above may be adopted. The main thing is that the coupler fixing members 37 are slidably fitted into at least either of couplers 8 or 9 among the first and second couplers 8, 9, and the screws 43, 44 inserted into the through holes 41, 42 formed in the couplers 8 or 9 into which the coupler fixing members 37 are slidably fitted are screwed onto the screw holes 40 formed in the coupler fixing members 37, whereby the couplers 8, 9 and the coupler fixing members 37 are detachably/attachably fixed.

Here, in the case in which the structure in which the coupler fixing members 37 are fixed in advance to either of the first or second couplers 8, 9 is adopted, when the respective second couplers 9 are fixed to the respective props attached thereto as in the present example, it is preferred that the coupler fixing members 37 are fixed in advance to the second couplers 9. Suppose that the coupler fixing members 37 are undetachably fixed in advance to the first couplers 8. Before the coupler fixing members 37 are fixed to the second couplers 9 by the screw 44, when the first couplers 8 of the state shown in FIG. 1 are lowered downward along the props 6, the coupler fixing members 37 passing through the attachment holes 39 of the second couplers 9 become largely protruded downward from the second coupler 9, whereby the props 6 cannot be fixed on the pallet 2. If the coupler fixing members 37 are undetachably fixed in advance to the second couplers 9, even when the first couplers 8 shown in FIG. 1 are lowered downward along the props 6 before the coupler fixing members 37 are screwed onto the first couplers 8, the coupler fixing members 37 merely protrude relatively upward over the first couplers 8 while sliding inside the attachment holes 38 of the first couplers 8, whereby the props 6 in this state can be attached to the pallet 2 without any trouble. If the coupler fixing members 37 are formed so as to be shorter than the length of the prop 6, when the prop unit 32 is folded up as shown in FIG. 6, the coupler fixing members 37 fixed to the second couplers 9 are fitted in the length range of the props 6, whereby the inconvenience that the folded prop unit 32 is large-sized can be prevented.

As described above, although it is desirable that the coupler fixing members 37 are fixed in advance to the second couplers 9, the fixing can be executed in various manners.

Figure 18:
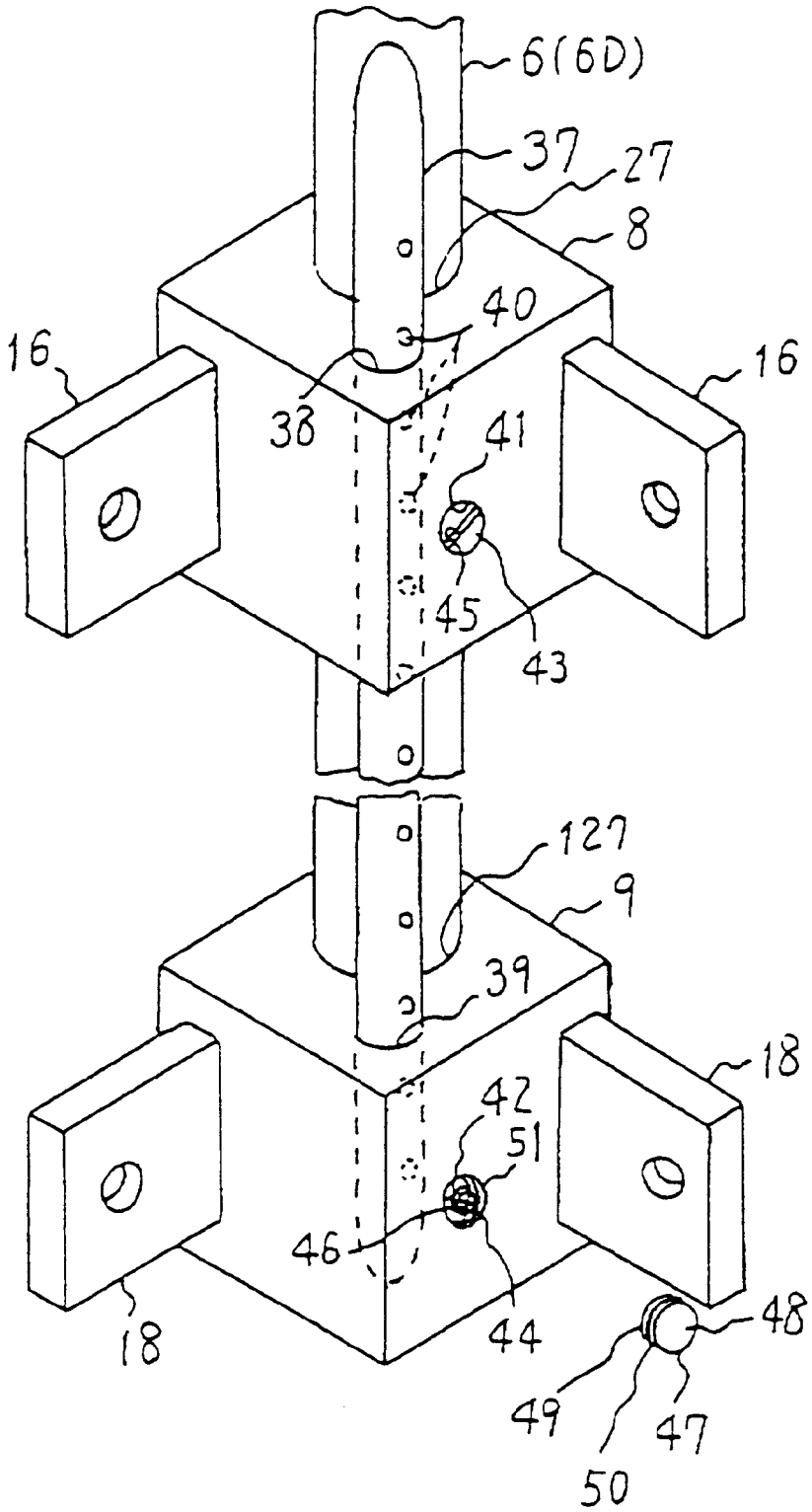
FIG. 18 is a perspective view showing an example in which the first and second couplers are fixed on the coupler fixing member by screws of different forms.

For example, as shown in FIG. 18, a screw having a relatively wide groove 45 in the head with which a coin which is not shown can engage is employed as the screw 43 detachably fixing the coupler fixing member 37 to the first coupler 8. On the other hand, a screw having a narrow cross groove 46 in the head with which only a tool, such as a screwdriver, can engage is employed as the screw 44 fixing the coupler fixing member 37 to the second coupler 9. With this, a person in charge handling the article carrying/keeping device rotates the screw 43 fixing the first coupler 8 to the coupler fixing member 37, employing a coin he carries, so as to remove the coupler fixing member 37 from the first coupler 8 when the prop unit 32 has to be folded up as shown in FIG. 6 while the coupler fixing member 37 fixed to the first and second couplers 8, 9 by the screws 43, 44 is made in a free state. Since the screw 44 fixing the second coupler 9 to the coupler fixing member 37 cannot be rotated to be loosened without employing the tool, if the person in charge knows that only either of the screws 43 or 44 has to be loosened, he quite naturally rotates and loosens the screw 43 fixing the first coupler 8 to the coupler fixing member 37. With this, the screw 44 is not loosened, and the coupler fixing member 37 remains fixed to the second coupler 9. Thus, the screw 44 is constituted so that loosening the screw 44 is more difficult than the screw 43. The coupler fixing member 37 is substantially undetachably fixed to the second coupler 9 by constituting the screw 44 not to be loosened.

Figure 19:
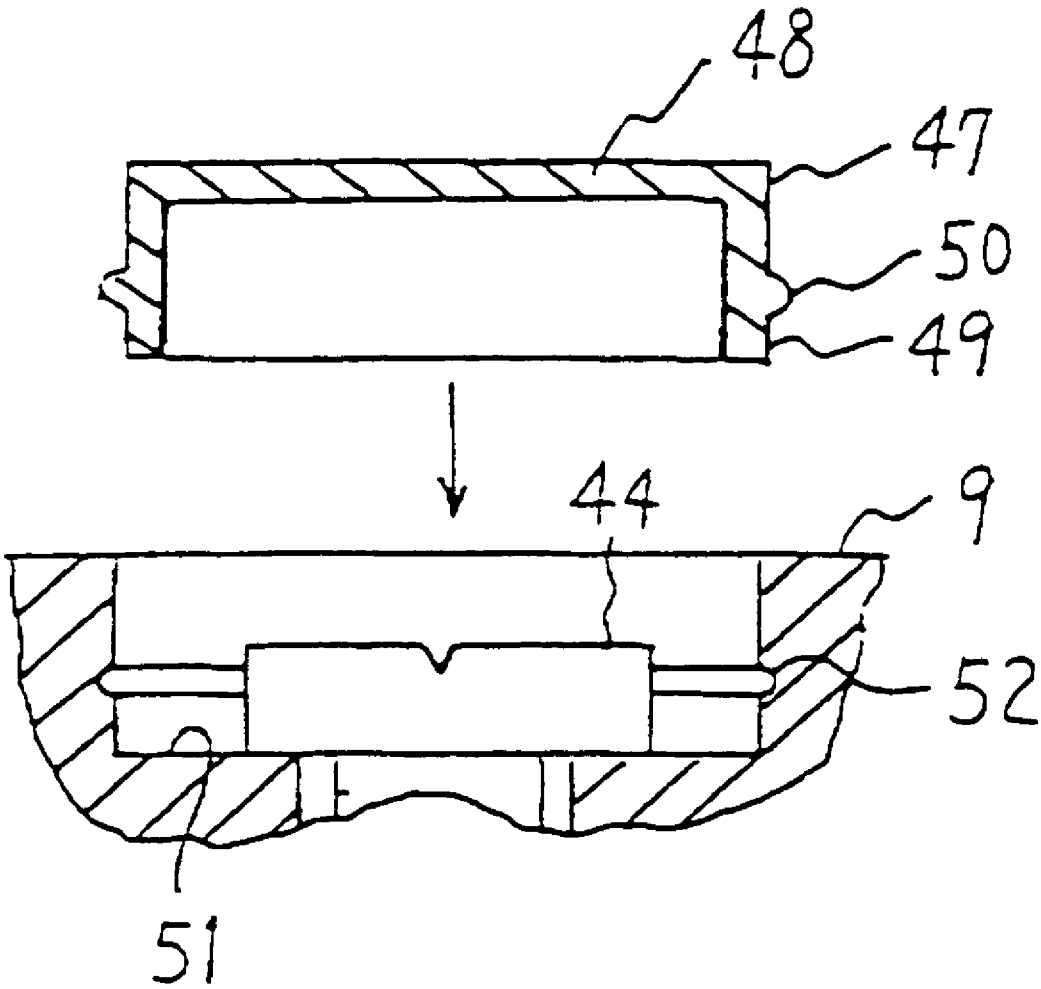
FIG. 19 is a sectional view of a cap.

Otherwise, the screw 44 fixing the coupler fixing member 37 to the second coupler 9 may be covered by a cap 47 as shown in FIG. 18. This cap 47 has a disklike base part 48 and a cylindrical part 49 integrally formed with the base part 48, and an annular protrusion 50 is provided on the outer periphery of the cylindrical part 49 in a protruding manner as shown in FIG. 19. The cap 47 is fitted into a recess 51 of the second coupler 9 into which the head of the screw 44 fixing the coupler fixing member 37 to the second coupler 9 is accommodated, and at this time, the protrusion 50 engages an annular grooves 52 formed on the peripheral wall defining the recess 51. With this, the head of the screw 44 is covered by the base part 48 and the cylindrical part 49 of the cap 47. Thus, the screw 44 cannot be seen by the person in charge so that it becomes difficult for the person in charge to rotate the screw 44, and it can be prevented that the coupler fixing member 37 is detached from the second coupler 9 by the person in charge, whereby the coupler fixing member 37 remains fixed to the second coupler 9.

As described above, by fixing the second couplers 9 to the respective props 6 to which the couplers 9 are attached and constituting the screws 44 fixing the coupler fixing members 37 to the second couplers 9 so that loosening the screws 44 is more difficult than loosening the screws 43 which fix the coupler fixing member 37 to the first coupler 8, the second couplers 9 and the coupler fixing members 37 can be fixed at all times.

The respective second couplers 9 may be fixed to the respective props 6 to which the couplers 9 are attached, and the coupler fixing members 37 may be fixed to the second couplers 9 in a undetachable manner in a normal usage, for example, by welding, an adhesive, or the like, without using the screws 44. Also, in this case, the first couplers 8 and the coupler fixing members 37 are detachably/attachably fixed by screwing the screws 43 inserted into the through holes 41 formed in the first couplers 8 onto the screw holes 40 formed in the coupler fixing members 37 slidably fitted into the first couplers 8.

Figure 20:
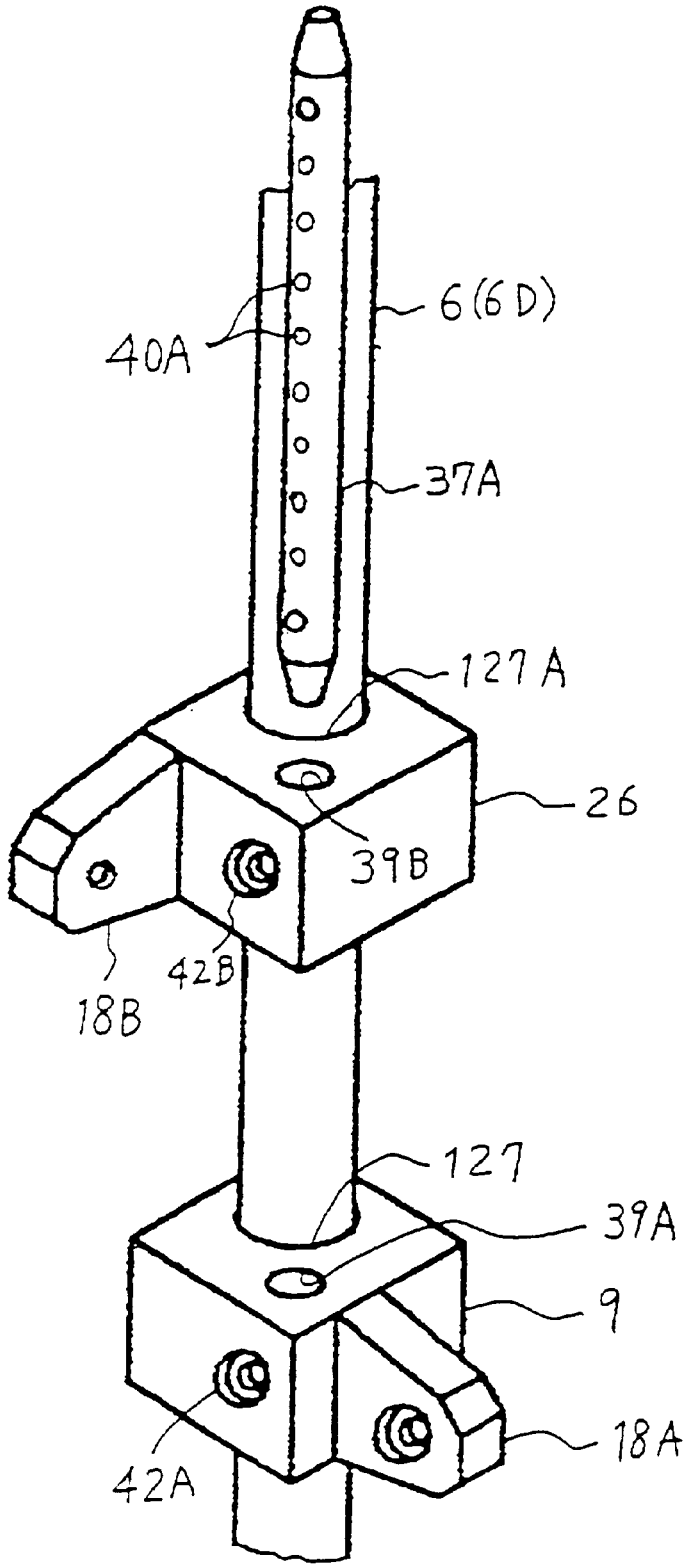
FIG. 20 is a perspective view showing a manner before a coupler fixing member is inserted into second and third couplers.
Figure 21:
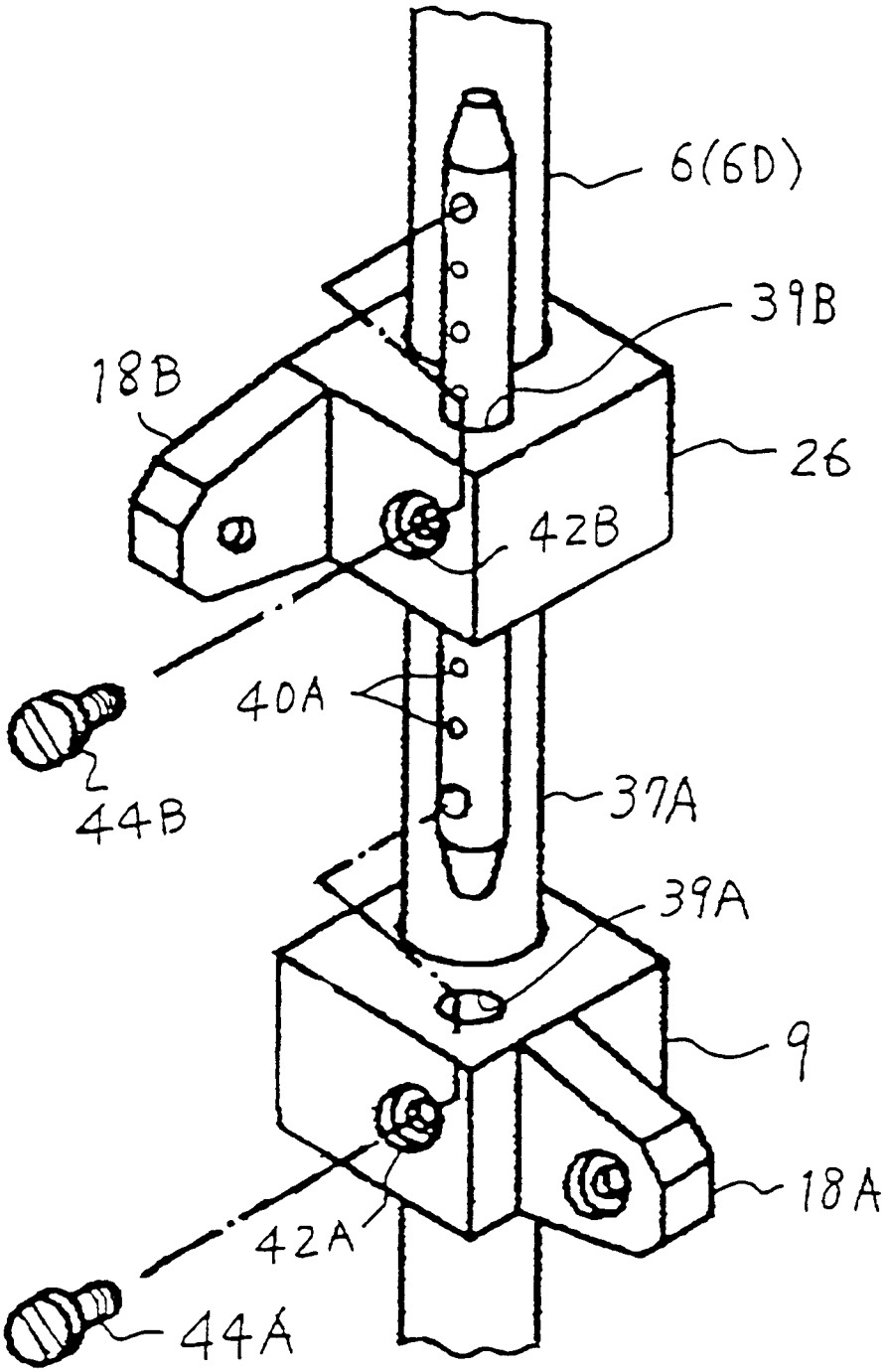
FIG. 21 is a perspective view showing a manner of the time when the coupler fixing member is inserted into the second and third couplers.
Figure 22:
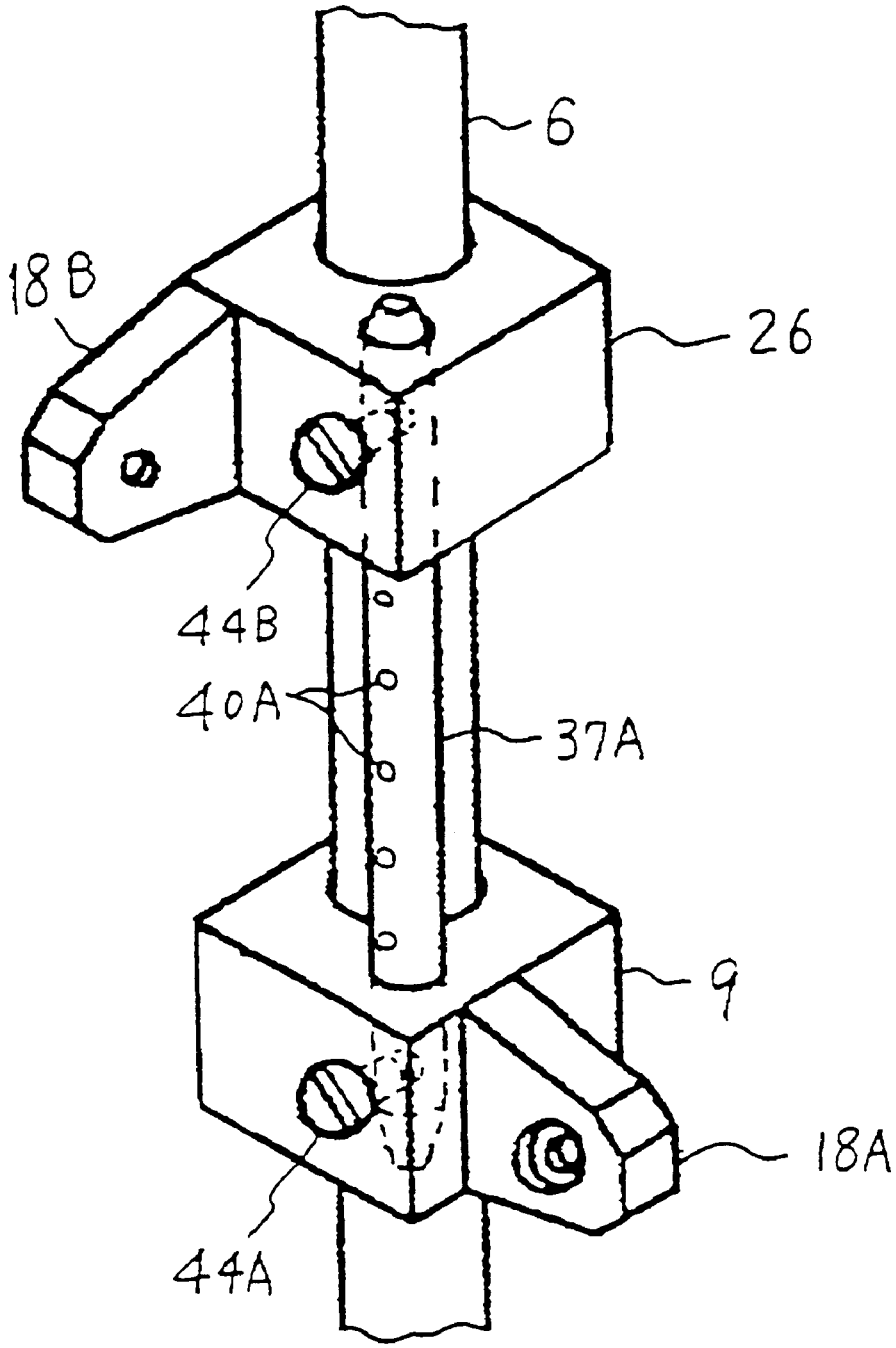
FIG. 22 is a perspective view showing a manner of the time when the second and third couplers are fixed on the coupler fixing member by means of screws.

The second form of article carrying/keeping device explained earlier referring to FIG. 7 to FIG. 14 is also constituted so that the second and third couplers 9, 26 can be fixed/coupled by the coupler fixing members. These coupler fixing members are fixed to the second and third couplers 9, 26 attached to the respective props 6 so as to fix/couple the second and third couplers 9, 29 with each other. A total of four coupler fixing members are provided, and one coupler fixing member 37A among them is shown in FIG. 20 to FIG. 23 (the coupler fixing member 37A is not shown in FIG. 7 to FIG. 10 and FIG. 12 to FIG. 14). In FIG. 20 to FIG. 22 also, the drawings of the coupling members pivotally mounted on the tongue piece 18A, 18B of the respective couplers 9, 26 are omitted.

As shown in FIG. 20 to FIG. 22, attachment holes 39A, 39B passing through parallel to the holes 127, 127A into which the props 6 are fitted and being arranged concentrically with each other are formed in the second and third couplers 9, 26. For example, the coupler fixing member 37A formed into a rod shape by a rigid material, such as a metal, a hard resin, or the like has a diameter by which the members 37A can be fitted into the attachment holes 39A, 39B without unsteadiness and has the plurality of screw holes 40A along the longitudinal direction thereof.

Similarly to the case of the coupler fixing member 37 of the first form of carrying/keeping device, after the intervals between the props are adjusted, the coupler fixing member 37A is inserted into the attachment holes 39A, 39B of the second and third couplers 9, 26 as shown in FIG. 21 and FIG. 22, and the coupler fixing members 37A are slidably fitted into the attachment holes 39A, 39B of the second and third couplers 9, 26. Next, the respective screws 44A, 44B are inserted into the through holes 42A, 42B formed in the respective second and third couplers 9, 26, and the respective screws 44A, 44B are screwed onto the female screws of any of the screw holes 40A formed in the coupler fixing members 37A so as to screw the respective screws 44A, 44B up. With this the second and third couplers 9, 26 and the coupler fixing members 37A are detachably/attachably fixed, and the second and third couplers 9, 26 are mutually fixed/coupled via the coupler fixing members 37A. Similarly, the second and third couplers 9, 26 attached to the other props are mutually fixed/coupled via the coupler fixing members.

As described above, when the second and third couplers 9, 26 are mutually fixed so as to maintain the interval between the couplers 9, 26 at a constant value, both the couplers 9, 26 are not fixed to the props 6. Therefore, before the four props 6 are attached to the pallet 2, the second and third couplers 9, 26 can be slidable on the respective props 6 in the longitudinal direction thereof. When the props 6 in this state are attached to the pallet 2 as described above so as to carry the article, even when pitching/rocking of the load-carrying platform of a truck or rocking due to an earthquake is added to the article carrying/keeping device, it can be restrained effectively that the article carrying/keeping device pitches/rocks severely. If the props 6 are slidably fitted into the second and third article carrying/keeping devices 9, 26 mutually fixed/coupled, when an external pitching/rocking force is added to the article carrying/keeping device, pitching/rocking of the article carrying/keeping device can be absorbed effectively by the couplers 9, 26. Thus, particularly, when the article carrying/keeping devices are vertically stacked, it can be restrained that pitching/rocking of the lower side article carrying/keeping device is conveyed to the upper side article carrying/keeping device, whereby the entire stability of the stacked article carrying/keeping devices can be enhanced. Even when the weight of the article arranged in the upper side article carrying/keeping device is greater than the weight of the article arranged in the lower side article carrying/keeping device, the entire stability can be enhanced. Thus, the person in charge of the article carrying/keeping devices can arrange articles in the respective article carrying/keeping devices and can vertically stack the article carrying/keeping devices without particularly considering the weights of the respective articles to be transported, whereby the work efficiency can be enhanced.

When the fixing between the second and third couplers 9, 26 is released, the screws 44A, 44B are loosened, and the coupler fixing members 37A are taken out from the attachment holes 39A, 39B. In this example also, the coupler fixing members 37A may be fixed to either of the second or the third couplers 9, 26 so as not to be detached. By adopting this type of structure, the workability of the time when the second and third couplers 9, 26 are fixed/coupled or the fixing of the couplers 9, 26 is released is enhanced, and loss of the coupler fixing members 37A can be prevented. In this case also, since the coupler fixing members 37A are positioned approximately parallel to the props 6 in a state where the members 37A are attached to the couplers 9, 26, even when the coupler fixing members 37A are detachably fixed to either of the couplers 9 or 26, before the coupler fixing members 37A are fixed to the other couplers by the screws, the intervals between the respective props 6 can be adjusted freely without being disturbed by the coupler fixing members 37A.

As described above, in the article carrying/keeping device of the present example, the couplers 9, 26 and the coupler fixing members 37A are detachably/attachably fixed by slidably fitting the coupler fixing members 37A into at least either of the couplers 9 or 26 among the second and third couplers 9, 26, and screwing the screws 44A, 44B inserted into the through holes 42A, 42B formed in the couplers 9 or 26 into which the coupler fixing members 37A are slidably fitted onto the screw holes 40A formed in the coupler fixing members 37A.

Here, when the structure is adopted in which the coupler fixing members 37A are fixed in advance to either of the second or third couplers 9, 26, it is desired that the coupler fixing members 37A are fixed to the second couplers 9 in advance. Suppose that the coupler fixing members 37A are undetachably fixed to the third couplers 26 in advance, when the prop unit 32A are folded up as shown in FIG. 11 in a state where the coupler fixing members 37A are not fixed to the second couplers 9 by the screws 44A, the coupler fixing members 37A passing through the attachment holes 39A of the second couplers 9 become largely protruded downward in FIG. 11 beyond the lower ends of the respective props 6 as shown in FIG. 11 by chain lines, whereby the full length of the folded prop unit 32A becomes long.

On the other hand, if the coupler fixing members 37A are undetachably fixed to the second couplers 9 in advance, when the prop unit 32A is folded up as shown in FIG. 11 in a state where the coupler fixing members 37A are not fixed to the third couplers 26 by the screws 44B, since the coupler fixing members 37A become extended upward in FIG. 11 while passing through the attachment holes 39B of the third couplers 26 as shown by solid lines in FIG. 11, the coupler fixing members 37A are fitted in the length range of the props 6 of the folded prop unit 32A. Thus, the inconvenience that the full length of the folded prop unit 32A becomes long can be prevented.

Figure 23:
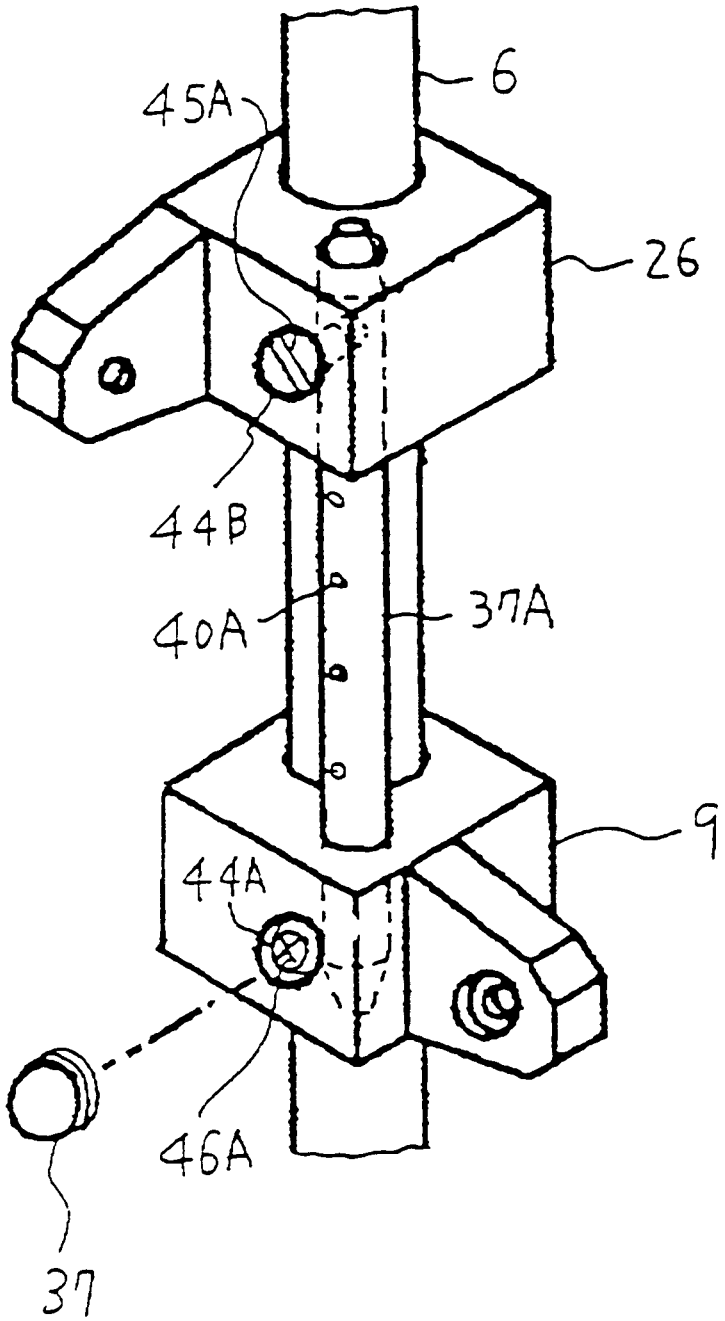
FIG. 23 is a perspective view showing an example in which the second and third couplers are fixed on the coupler fixing member by screws of different forms.

The same method can be adopted as that explained earlier referring to FIG. 18 and FIG. 19 as the fixing method of the time when the coupler fixing members 37A are fixed to the second couplers 9 in advance. That is, as shown in FIG. 23, a screw having a wide groove 45A which can be loosened easily by a coin is employed as the screw 44B for fixing the coupler fixing member 37A to the third coupler 26, and a screw having a cross groove 46A which cannot be loosened without employing a tool is employed as the screw 44A fixing the coupler fixing member 37A to the second coupler 9. With this, the person in charge loosens the screw 44B fixing the third coupler 26, and the coupler fixing members 37A remains fixed to the second coupler 9 while the screw 44A fixing the second coupler 9 is not loosened. Otherwise, the screw 44A fixing the coupler fixing member 37A to the second coupler 9 may be covered and hidden by the cap 37 explained earlier referring to FIG. 18 and FIG. 19 so that the screw 44 may not be loosened.

As described above, the screw 44A fixing the coupler fixing member 37A to the second coupler 9 is constituted in such a manner that it is more difficult to loosen the screw 44A than loosening the screw 44B fixing the coupler fixing member 37A to the third coupler 26.

Otherwise, the third coupler 26 and the coupler fixing member 37A may be detachably/attachably fixed by fixing the coupler fixing member 37A to the second coupler 9 undetachably in a normal usage by means of welding, an adhesive, or the like and slidably fitting the member 37A into the third coupler 26 so that the screw 44B inserted into the through hole 42B formed in the third coupler 26 is screwed onto the screw hole 40A formed in the coupler fixing member 37A.

Figure 24:
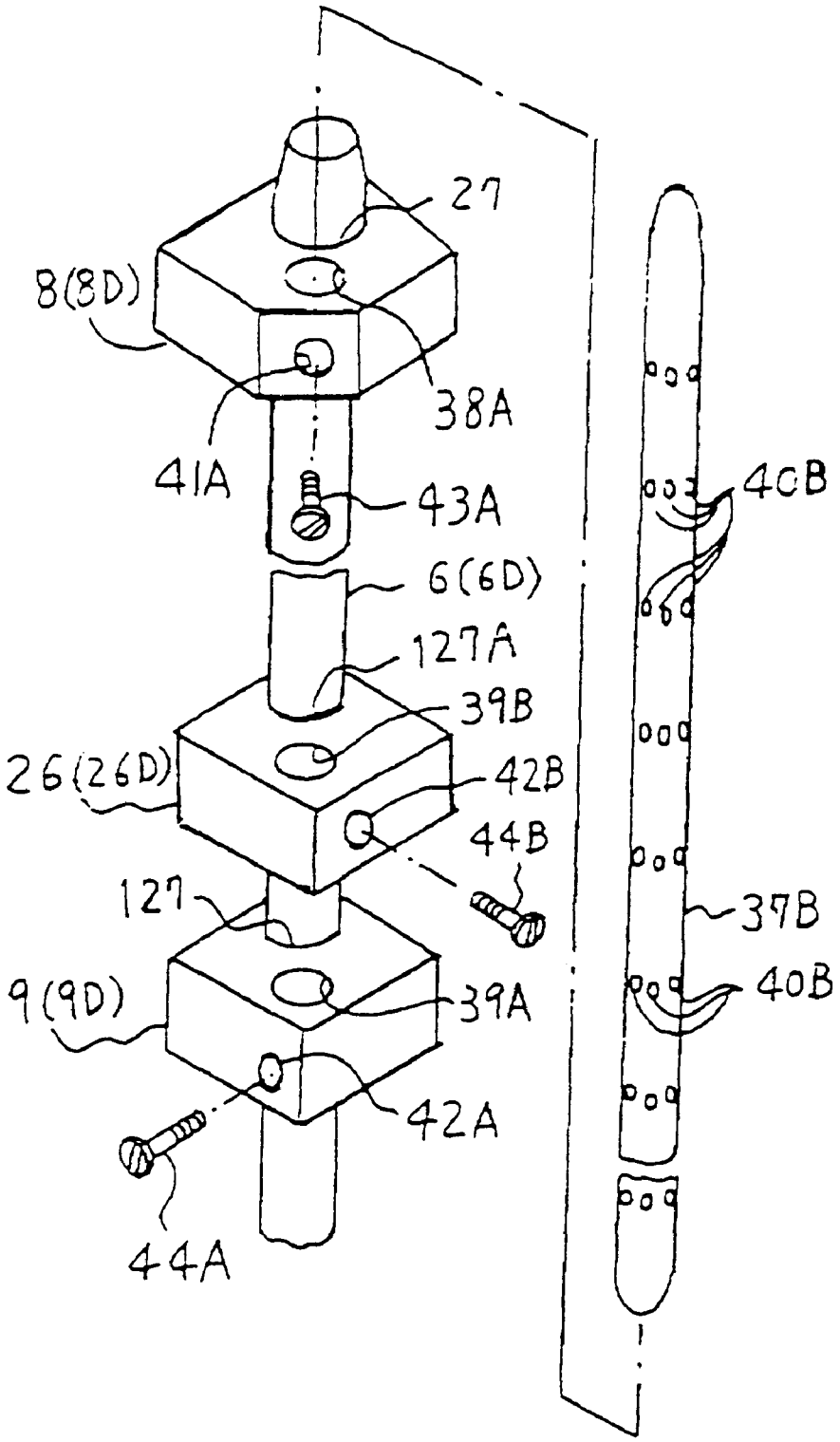
FIG. 24 is a perspective view showing a manner before a coupler fixing member is inserted into first and third couplers.
Figure 25:
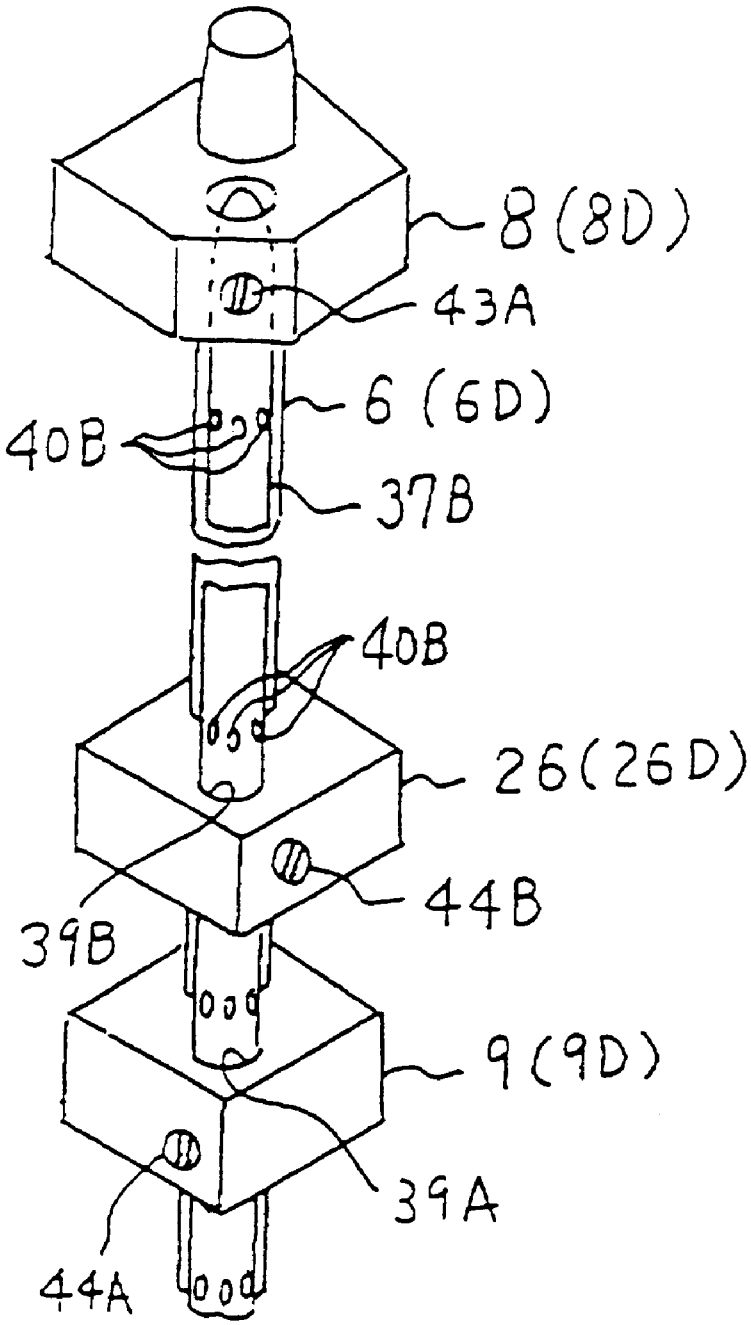
FIG. 25 is a perspective view showing a manner of the time when the coupler fixing member is fixed on the first to third couplers by means of screws.

In the second form of article carrying/keeping device 30A shown in FIG. 7 to FIG. 14, coupler fixing members fixing/coupling all the first to third three types of couplers 8, 9 26 may be provided as substitutes for the coupler fixing members 37A described above. This type of coupler fixing members are fixed to the first to third couplers 8, 9, 26 attached to the respective props 6 and are to fix/couple the first to third couplers 8, 9, 26 mutually. A total of four coupler fixing members are provided, and one coupler fixing member 37B among these members is shown in FIG. 24 and FIG. 25 (the coupler fixing member 37B is not shown in FIG. 7 to FIG. 14). In FIG. 24 and FIG. 25, the drawing of the tongue pieces of the respective couplers 8, 9, 26 and the coupling members pivotally mounted on the tongue pieces are omitted.

As shown in FIG. 24 and FIG. 25, attachment holes 38A, 39A, 39B parallel passing through the holes 27, 127, 127A into which the props 6 are fitted and being concentrically arranged with each other are formed in the first to third couplers 8, 9, 26. The coupler fixing member 37B formed into a rod shape made of a high rigidity material, such as a metal, a hard resin, or the like has a diameter by which the member 37B can be fitted into the attachment holes 38A, 39A, 39B without unsteadiness and has the plurality of screw holes 40B along the longitudinal direction thereof.

Similarly to the case of the coupler fixing member 37 of the first form of article carrying/keeping device, the first to third couplers 8, 9, 26 and the coupler fixing member 37B are detachably/attachably fixed, and the first to third couplers 8, 9, 26 are mutually fixed/coupled via the coupler fixing member 37B by inserting the coupler fixing member 37B into the attachment holes 38A, 39A, 39B of the first to third couplers 8, 9, 26 as shown in FIG. 24 and FIG. 25 after adjusting the intervals between the props, slidably fitting the coupler fixing member 37B into the attachment holes 38A, 39A, 39B of the first to third couplers 8, 9, 26, inserting the respective screws 43A, 44A, 44B into the through holes 41A, 42A, 42B formed in the respective first to third couplers 8, 9, 26, screwing the respective screws 43A, 44A, 44B onto the female screws of any ones of the screw holes 40B formed in the coupler fixing member 37B, and screwing the respective screws 43A, 44A, 44B up. The first to third couplers 8, 9, 26 attached to the other props are mutually fixed/coupled via the coupler fixing members similarly.

As described above, by fixing/coupling the first to third couplers 8, 9, 26 attached to the respective props 6 via the coupler fixing members 37B, when the article is arranged in the article carrying/keeping device so that the article is transported, the stability of the article carrying/keeping device can be enhanced similar to the case of the first form of article carrying/keeping device. It is similar to the case of the first form of article carrying/keeping device that the props 6 can be attached quickly to the pallet 2 by fixing the first to third couplers 8, 9 26 attached to the respective props 6 by means of the coupler fixing members 37B before the props 6 are attached to the pallet 2, after the intervals of the respective props are adjusted in accordance with the intervals of the protruding portions 7 of the employed pallet 2 before the props are attached to the pallet 2.

When the fixing among the first to third couplers 8, 9, 26 is released, the screws 43A, 44A, 44B are loosened, and the coupler fixing members 37B are taken out from the attachment holes 38A, 39A, 39B. However, it is also possible in the case of this example, that the coupler fixing member 37B is undetachably fixed to one of the first to third couplers 8, 9, 26. By adopting this structure, the workability of the time of fixing/coupling the first to third couplers 8, 9, 26 or releasing the fixing can be enhanced and the loss of the coupler fixing members 37B can be prevented. In this case, also, since the coupler fixing members 37B are positioned approximately parallel to the props 6 in a state where the members 37B are attached to the couplers 8, 9, 26, even when the coupler fixing member 37B is undetachably fixed to one of the couplers 8, 9, 26, if the state is prior to the fixing of coupler fixing member 37B to the other couplers by means of the screws, the intervals between the props 6 can be adjusted freely without being disturbed by the coupler fixing member 37B.

As described above, in the article carrying/keeping device of the present invention, the couplers 8, 9, 26 and the coupler fixing member 37B are detachably/attachably fixed by slidably fitting the coupler fixing member 37B into at least two couplers among the first to third couplers 8, 9, 26 and screwing the screws 43A, 44A, 44B inserted into the through holes 41A, 42A, 42B formed in the couplers into which the coupler fixing member 37B is slidably fitted onto the screw holes 40B formed in the coupler fixing member 37B.

Here, when the structure in which the coupler fixing member 37B is fixed to one of the first to third couplers 8, 9, 26 in advance is adopted as in the present example, in the case in which the respective first couplers 8 are fixed to the respective props 6 attached thereto, it is preferred that the coupler fixing member 37B are fixed to the first couplers 8 in advance. Suppose that the coupler fixing members 37B are undetachably fixed to the second couplers 9 in advance, if the second and third couplers 9, 26 in the state shown in FIG. 7 are lifted upward along the props 6 before the coupler fixing members 37B are fixed to the first and third couplers 8, 26 by the screws 43A, 44B, the coupler fixing members 37B passing through the attachment holes 38A of the first couplers 8 become largely protruded upward beyond the first couplers 8, and in this state, the other article carrying/keeping device cannot be stacked on the article carrying/keeping device. This case is the same as that in which the coupler fixing members 37B are fixed to the third couplers 26 in advance. If the coupler fixing members 37B are undetachably fixed to the first couplers 8 in advance, even when the second and third couplers 9, 26 shown in FIG. 7 are lifted upward along the props 6 before the coupler fixing members 37B are screwed up onto the second and third couplers 9, 26, the coupler fixing members 37B merely relatively protrude downward beyond the second and third couplers 9, 26 while sliding to the attachment holes 39A, 39B of the second and third couplers 9, 26, and the other article carrying/keeping device can be stacked on the article carrying/keeping device in this state without any trouble. If the length of the coupler fixing members 37B are formed shorter than that of the props 6, when the prop unit 32A is folded up as shown in FIG. 11, the coupler fixing members 37B fixed to the first couplers 8 are fitted in the length range of the props 6, whereby the inconvenience that the folded prop unit 32A is large-sized can be prevented.

Figure 26:
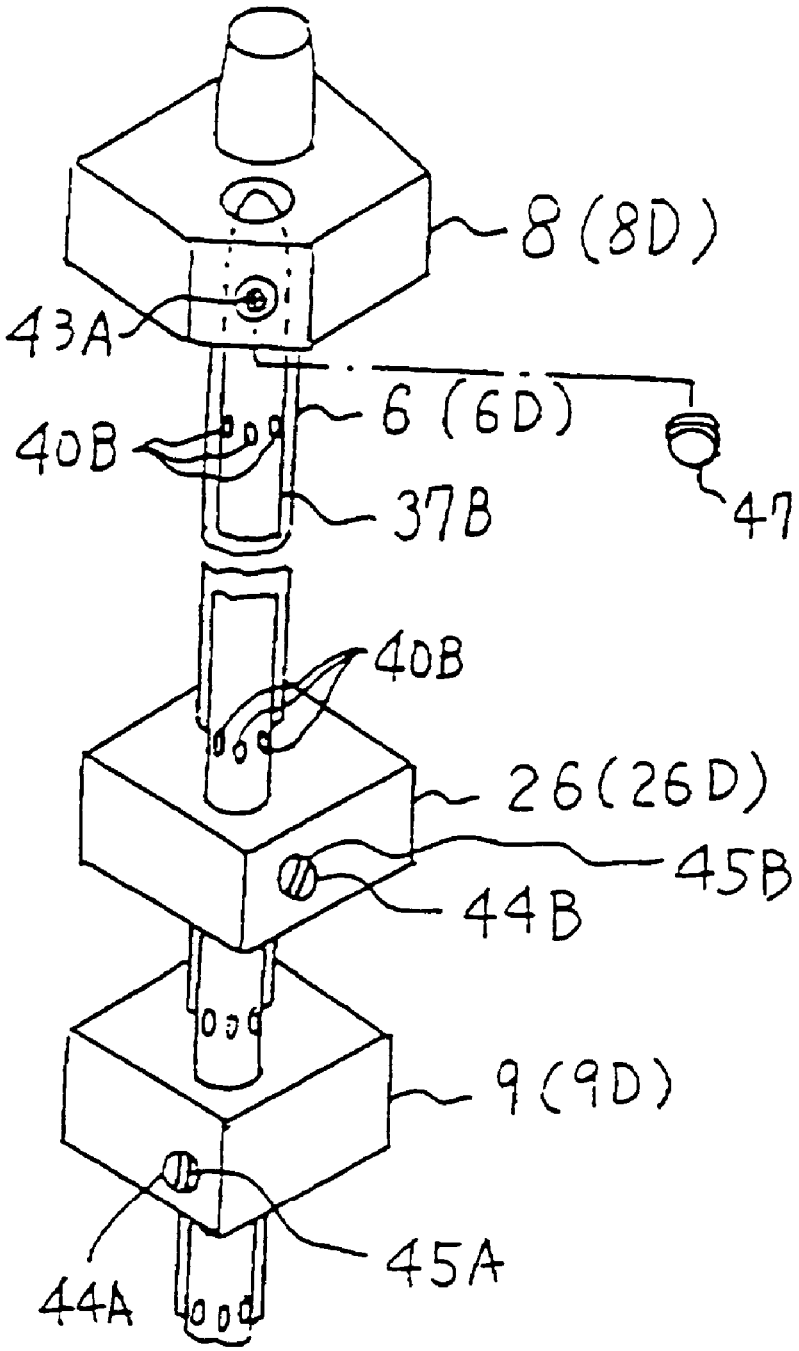
FIG. 26 is a perspective view showing an example in which the first coupler and the second and third couplers are fixed on the coupler fixing member by screws of different forms.

The same method can be adopted as that explained earlier referring to FIG. 18 and FIG. 19 as the fixing method of the time when the coupler fixing members 37B are fixed to the first couplers 8 in advance. That is, as shown in FIG. 26, screws having wide grooves 45A, 45B which can be loosened easily by a coin are employed as the screws 44A, 44B for fixing the coupler fixing member 37B to the second and third couplers 9, 26, and a screw having a cross groove which cannot be loosened without employing a tool is employed as the screw 43A fixing the coupler fixing member 37B to the first coupler 8. With this, the person in charge loosens the screws 44A, 44B fixing the second and third couplers 9, 26. The coupler fixing members 37B remains fixed to the first coupler 8 while the screw 43A fixing the first coupler 8 is not loosened. Otherwise, the screw 43A fixing the coupler fixing member 37B to the first coupler 8 may be covered and hidden by the cap 47 explained earlier referring to FIG. 18 and FIG. 19 so that the screw 43A may not be loosened.

As described above, the screw 43A fixing the coupler fixing member 37B to the first coupler 8 is constituted in such a manner that it is more difficult to loosen the screw 43A than loosening the screws 44A, 44B fixing the coupler fixing member 37B to the second and third couplers 9, 26 by fixing the respective first couplers 8 to the respective props 6 to which the couplers 8 are attached.

Otherwise, the second and third couplers 9, 26 and the coupler fixing members 37B maybe detachably/attachably fixed by fixing the respective first couplers 8 to the respective props 6 to which the couplers 8 are attached, fixing the coupler fixing members 37B to the first couplers 8 undetachably in a normal usage by means of welding, an adhesive, or the like, and screwing the screws 44A, 44B inserted into the through holes 42A, 42B formed in the second and third couplers 9, 26 onto the screw hole 40B formed in the coupler fixing member 37B which are slidably fitted into the second and third couplers 9, 26.

Figure 27:
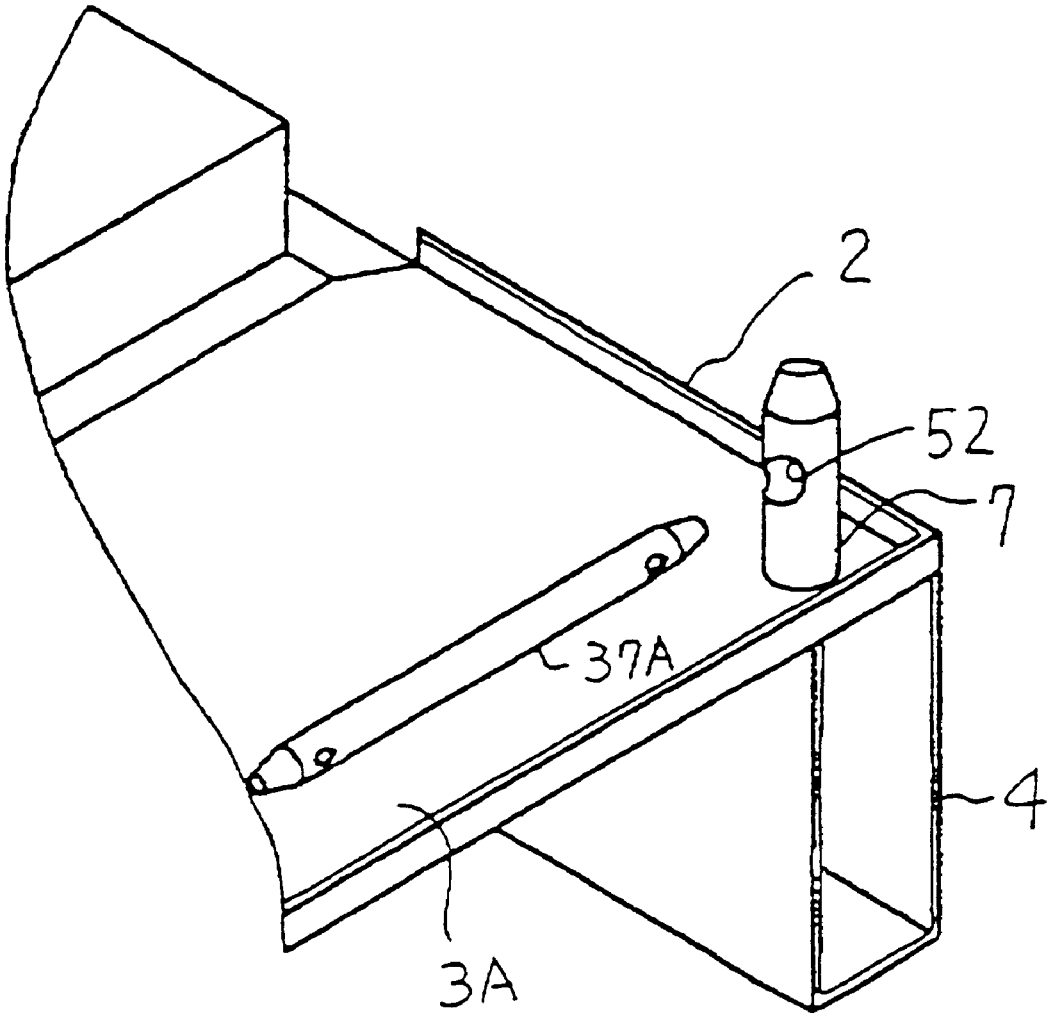
FIG. 27 is a perspective view showing a manner before a coupler fixing member is inserted into a reinforcement member of a pallet.
Figure 28:
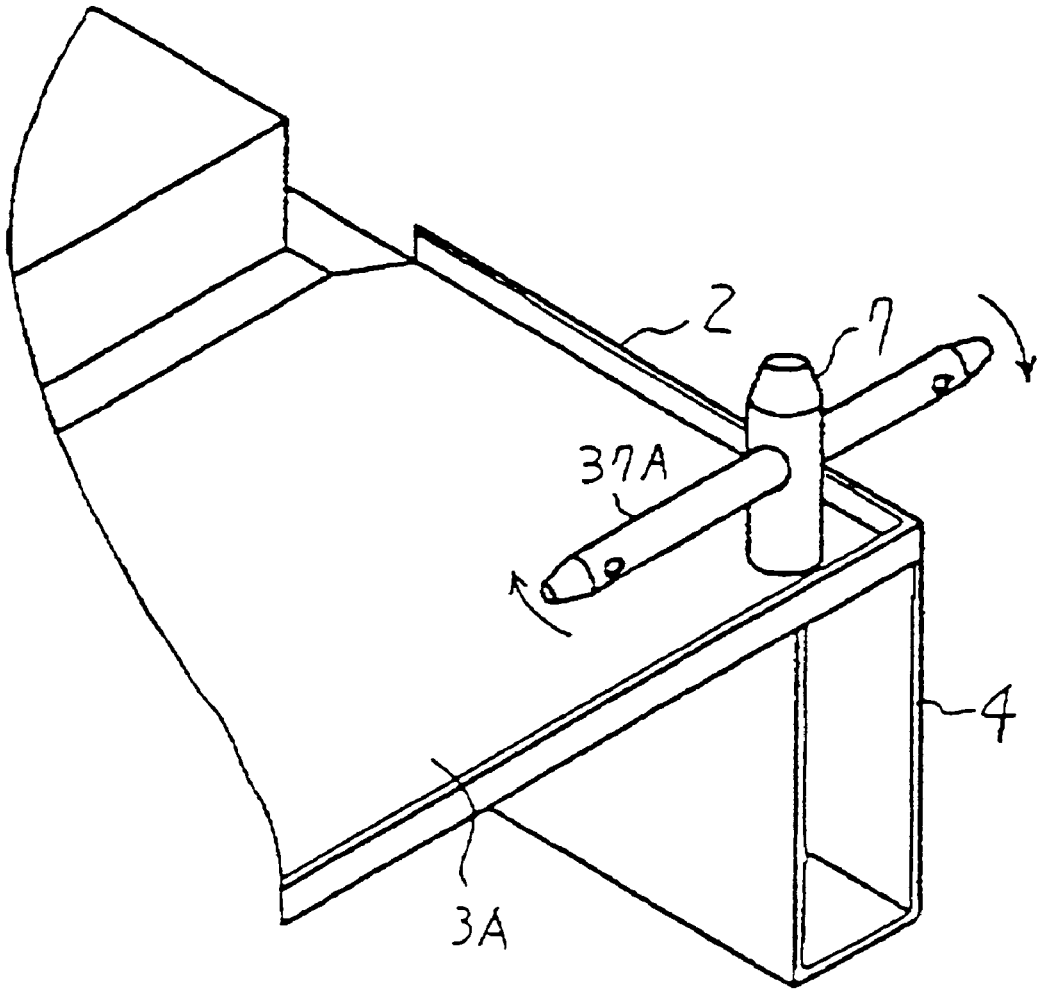
FIG. 28 is a perspective view showing a manner of the time when the coupler fixing member is inserted into the reinforcement member of the pallet.

Although the article carrying/keeping devices of the respective embodied examples explained above have the coupler fixing members 37, 37A, or 37B, the coupler fixing members can be utilized as tools necessary for the maintenance or repair for the article carrying/keeping device. For example, as shown in FIG. 27, there is the case in which the protruding portions 7 of the pallet 2 are loosened by pitching/rocking or the like added to the pallet 2 when the structure is adopted wherein the protruding portions 7 are fixed to the reinforcement members 3A by screwing the male screws (not shown) of the lower parts of the protruding portions 7 composed of pins onto the screw holes formed in the reinforcement members 3A of the pallet 2 or the nuts (not shown) fixed on the back side face of the reinforcement members 3A. In this situation, the protruding portions 7 can be fastened so as to be strongly re-fixed to the reinforcement members 3A, for example, by inserting the coupler fixing members 37A to the holes 52 formed in the protruding portions 7 as shown in FIG. 28 and rotating the coupler fixing members 37A. Like this, even when the protruding portions 7 are loosened, the protruding portions 7 can be fastened by means of the coupler fixing members 37A without preparing the a special tool.

In the above, a large number of embodied examples of the present invention are explained. It is also possible to appropriately combine the respective structures of the examples so as to construct an article carrying/keeping device. The present invention can be applied to an article carrying/keeping device for substantially any type of articles other than the articles exemplified earlier, such as, for example, an automobile, a part such as an engine therefor, a piece of furniture, an architectural material.

According to the invention of the first aspect, since the intervals between the respective props can be adjusted, various sizes of articles can be transported or kept efficiently. Further, since the first and second couplers can be fixed/coupled by means of the coupler fixing members, the stability of the article carrying/keeping device at the time when the article is transported by the article carrying/keeping device can be enhanced. There is no need to form the screw holes in the coupler themselves, and thus the couplers can be constituted of a resin without any trouble.

According to the invention of the second aspect, the work of the time when the first and second couplers are fixed/coupled by the coupler fixing members can be executed easily.

According to the inventions of the third and fourth aspects, the occurrence of the inconvenience that the props cannot be attached to the pallet due to an obstacle caused by the coupler fixing members can be prevented.

According to the invention of the fifth aspects, since the intervals between the respective props can be adjusted, various sizes of articles can be transported or kept efficiently. Further, by fixing/coupling the second and third couplers by means of the coupler fixing members, when the article is loaded so as to transport it, even if an external pitching/rocking force is added to the article carrying/keeping device, it can be prevented that the article carrying/keeping device severely pitches/rocks. Further, there is no need to form the screw holes in the coupler themselves, and thus the couplers can be constituted of a resin without any trouble.

According to the invention of the sixth aspects, the work of the time when the second and third couplers are fixed/coupled by the coupler fixing members can be executed easily.

According to the inventions of the seventh and eighth aspects, the inconvenience that the coupler fixing members protrude externally in a large scale when the props and the coupling members are folded up can be prevented.

According to the invention of the ninth aspect, since the intervals between the respective props can be adjusted, various sizes of articles can be transported or kept efficiently. Further, since the first to third couplers can be fixed/coupled by means of the coupler fixing members, the stability of the article carrying/keeping device at the time when the article is transported by the article carrying/keeping device can be enhanced. There is no need to form the screw holes in the coupler themselves, and thus the couplers can be constituted of a resin without any trouble.

According to the invention of the tenth aspect, the work of the time when the first to third couplers are fixed/coupled by the coupler fixing members can be executed easily.

According to the inventions of the eleventh and twelfth aspects, the occurrence of the inconvenience that the article carrying/keeping device cannot be stacked vertically due to an obstacle caused by the coupler fixing members can be prevented.

According to the invention of the thirteenth aspect, while the coupler fixing members remain fixed to ones of couplers, the intervals between the props can be adjusted without any trouble.

The present document incorporates by reference the entire contents of Japanese priority document, 11-250974 filed in Japan on Sep. 3, 1999.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An article carrying/keeping device comprising a pallet on which an article is placed, four props detachably attached to the pallet in an approximately vertically standing manner against an article placing face of the pallet, first and second couplers attached to the respective props along the longitudinal directions thereof, and first and second coupling members mutually coupling two props positioned adjacent to each other, wherein the second couplers are positioned lower than the first couplers in a state where the four props are attached to the pallet, the first and second coupling members are positioned mutually crossing in a state where the four props are attached to the pallet, one end sides of the respective first coupling members in the longitudinal directions thereof are rotatably coupled with the first couplers attached to one side props among two props positioned adjacent to each other, the other end sides in the longitudinal directions thereof are rotatably coupled with the second couplers attached to the other side props among two props positioned adjacent to each other, one end sides of the respective second coupling members in the longitudinal directions thereof are rotatably coupled with the first couplers attached to the other side props, the other end sides in the longitudinal directions thereof are rotatably coupled with the second couplers attached to the one side props among two props, and at least either of the first or second couplers are movably attached to the respective props to which the couplers are attached in the longitudinal directions of the props, wherein said device comprises coupler fixing members fixed to the first and second couplers attached to the respective props for fixing/coupling the first and second couplers with each other, said coupler fixing members are slidably fitted into at least one side couplers among the first and second couplers, and the couplers and the coupler fixing members are detachably/attachably fixed by screwing screws inserted into through holes formed in the couplers into which the coupler fixing members are slidably fitted onto screw holes formed in the coupler fixing members.

2. The article carrying/keeping device according to claim 1, wherein the first and second couplers and the coupler fixing members are detachably/attachably fixed by slidably fitting the coupler fixing members into the first and second couplers and screwing the respective screws inserted into the through holes formed in the respective first and second couplers onto the screw holes formed in the coupler fixing members.

3. The article carrying/keeping device according to claim 2, wherein the respective second couplers are fixed to the respective props to which the second couplers are attached, and the screws fixing the coupler fixing members to the second couplers are constituted in such a manner that loosening the screws fixing the coupler fixing members to the second couplers is more difficult than loosening the screws fixing the coupler fixing members to the first couplers.

4. The article carrying/keeping device according to claim 1, wherein the first couplers and the coupler fixing members are detachably/attachably fixed by fixing the respective second couplers to the respective props to which the second couplers are attached, undetachably fixing the coupler fixing members to the second couplers, and screwing the screws inserted into the through holes formed in the first couplers onto the screw holes formed in the coupler fixing members slidably fitted into the first couplers.

5. The article carrying/keeping device according to claim 1, wherein the coupler fixing members are positioned approximately parallel to the props in a state where the members are attached to the couplers.

6. An article carrying/keeping device comprising a pallet on which an article is placed, first to fourth props detachably attached to the pallet in an approximately vertically standing manner against an article placing face of the pallet, first to third couplers attached to the respective first to fourth props along the longitudinal directions thereof, and first and second coupling members mutually coupling the respective first and second props, the second and third props, the third and fourth props, and the fourth and first props positioned adjacent to each other, wherein in a state where the four props are attached to the pallet, the second and third couplers are positioned lower than the first couplers, and the second couplers are positioned lower than the third couplers, and in a state where the first to fourth props are attached to the pallet, the respective first and second coupling members are positioned in a state where the respective first and second coupling members cross mutually, respective one end sides of the first and second coupling members provided between the first and second props positioned adjacent to each other and the first and second coupling members provided between the third and fourth props positioned facing to the first and second props in the respective longitudinal directions of the members are rotatably coupled with the respective first couplers attached to the first and second props and the third and fourth props, the respective other end sides in the longitudinal directions thereof are rotatably coupled with the respective second couplers attached to the first and second props and the third and fourth props, respective one end sides of the first and second coupling members provided between the second and third props positioned adjacent to each other and the first and second coupling members provided between the fourth and first props positioned facing to the second and third props in the longitudinal directions of the members are rotatably coupled with the respective first couplers attached to the second and third props and the fourth and first props, the respective other end sides in the longitudinal directions thereof are rotatably coupled with the respective third couplers attached to the second and third props and the fourth and first props, and at least either of the second or third couplers among the first to third couplers are movably attached to the respective props to which the couplers are attached in the longitudinal directions of the props, wherein said device comprises coupler fixing members fixed to the second and third couplers attached to the respective props for fixing/coupling the second and third couplers with each other, said coupler fixing members are slidably fitted into at least one side couplers among the second and third couplers, and the couplers and the coupler fixing members are detachably/attachably fixed by screwing screws inserted into through holes formed in the couplers into which the coupler fixing members are slidably fitted onto screw holes formed in the coupler fixing members.

7. The article carrying/keeping device according to claim 6, wherein the second and third couplers and the coupler fixing members are detachably/attachably fixed by slidably fitting the coupler fixing members into the second and third couplers and screwing the respective screws inserted into the through holes formed in the respective second and third couplers onto the screw holes formed in the coupler fixing members.

8. The article carrying/keeping device according to claim 7, wherein the screws fixing the coupler fixing members to the second couplers are constituted in such a manner that loosening the screws fixing the coupler fixing members to the second couplers is more difficult than loosening the screws fixing the coupler fixing members to the third couplers.

9. The article carrying/keeping device according to claim 6, wherein the third couplers and the coupler fixing members are detachably/attachably fixed by undetachably fixing the coupler fixing members to the second couplers, slidably fitting the coupler fixing members into the third couplers, and screwing the screws inserted into the through holes formed in the third couplers onto the screw holes formed in the coupler fixing members.

10. The article carrying/keeping device according to claim 6, wherein the coupler fixing members are positioned approximately parallel to the props in a state where the members are attached to the couplers.

11. An article carrying/keeping device comprising a pallet on which an article is placed, first to fourth props detachably attached to the pallet in an approximately vertically standing manner against an article placing face of the pallet, first to third couplers attached to the respective first to fourth props along the longitudinal directions thereof, and first and second coupling members mutually coupling the respective first and second props, the second and third props, the third and fourth props, and the fourth and first props positioned adjacent to each other, wherein in a state where the four props are attached to the pallet, the second and third couplers are positioned lower than the first couplers, and the second couplers are positioned lower than the third couplers, and in a state where the first to fourth props are attached to the pallet, the respective first and second coupling members are positioned in a state where the respective first and second coupling members cross mutually, respective one end sides of the first and second coupling members provided between the first and second props positioned adjacent to each other and the first and second coupling members provided between the third and fourth props positioned facing to the first and second props in the respective longitudinal directions of the members are rotatably coupled with the respective first couplers attached to the first and second props and the third and fourth props, the respective other end sides in the longitudinal directions thereof are rotatably coupled with the respective second couplers attached to the first and second props and the third and fourth props, respective one end sides of the first and second coupling members provided between the second and third props positioned adjacent to each other and the first and second coupling members provided between the fourth and first props positioned facing to the second and third props in the longitudinal directions of the members are rotatably coupled with the respective first couplers attached to the second and third props and the fourth and first props, the respective other end sides in the longitudinal directions thereof are rotatably coupled with the respective third couplers attached to the second and third props and the fourth and first props, and at least either of the second or third couplers among the first to third couplers are movably attached to the respective props to which the couplers are attached in the longitudinal directions of the props, wherein said device comprises coupler fixing members fixed to the first to third couplers attached to the respective props for fixing/coupling the first to third couplers with each other, said coupler fixing members are slidably fitted into at least two couplers among the first to third couplers, and the couplers and the coupler fixing members are detachably/attachably fixed by screwing screws inserted into through holes formed in the couplers into which the coupler fixing members are slidably fitted onto screw holes formed in the coupler fixing members.

12. The article carrying/keeping device according to claim 11, wherein the first to third couplers and the coupler fixing members are detachably/attachably fixed by slidably fitting the coupler fixing members into the first to third couplers and screwing the respective screws inserted into the through holes formed in the respective first to third couplers onto the screw holes formed in the coupler fixing members.

13. The article carrying/keeping device according to claim 12, wherein the respective first couplers are fixed to the respective props to which the first couplers are attached, and the screws fixing the coupler fixing members to the first couplers are constituted in such a manner that loosening the screws fixing the coupler fixing members to the first couplers is more difficult than loosening the screws fixing the coupler fixing members to the second and third couplers.

14. The article carrying/keeping device according to claim 11, wherein the second and third couplers and the coupler fixing members are detachably/attachably fixed by fixing the respective first couplers to the respective props to which the first couplers are attached, undetachably fixing the coupler fixing members into the first couplers, and screwing the screws inserted into the through holes formed in the second and third couplers onto the screw holes formed in the coupler fixing members slidably fitted into the second and third couplers.

15. The article carrying/keeping device according to claim 11, wherein the coupler fixing members are positioned approximately parallel to the props in a state where the members are attached to the couplers.

* * * * *

UNITED STATES PATENT AND TRADEMARK OFFICE

CERTIFICATE OF CORRECTION

PATENT NO. : 6,343,555 B1
DATED : February 5, 2002
INVENTOR(S) : Arai et al.

It is certified that error appears in the above-identified patent and that said Letters Patent is hereby corrected as shown below:

Title page,
Item [75], the Inventor information should read:
-- [75] Inventors: Tomoaki Arai; Sakae Ishikawa,
both of Tokyo (JP) --

Signed and Sealed this

Eighth Day of October, 2002

*Attest:*

*Attesting Officer*

JAMES E. ROGAN
*Director of the United States Patent and Trademark Office*